US008167162B2

(12) United States Patent
Levey

(10) Patent No.: US 8,167,162 B2
(45) Date of Patent: May 1, 2012

(54) SANITARY BARRIER FOR BEVERAGE CONTAINER LID

(75) Inventor: William M. Levey, New York, NY (US)

(73) Assignee: Clean Coffee LLC, New York, NY (US)

( * ) Notice: Subject to any disclaimer, the term of this patent is extended or adjusted under 35 U.S.C. 154(b) by 744 days.

(21) Appl. No.: 12/178,421

(22) Filed: Jul. 23, 2008

(65) Prior Publication Data

US 2009/0223981 A1 Sep. 10, 2009

Related U.S. Application Data

(60) Provisional application No. 61/068,497, filed on Mar. 7, 2008.

(51) Int. Cl.
*B65D 41/00* (2006.01)
*B65D 51/18* (2006.01)

(52) U.S. Cl. ..... 220/359.2; 220/254.1; 220/212

(58) Field of Classification Search ..... 220/359.2, 220/359.1, FOR. 186, FOR. 203, 254.1, 718, 220/716, 257.2, 257.1, 256.1; 215/232, 200; *B65D 17/34, 41/00, 51/18*
See application file for complete search history.

(56) References Cited

U.S. PATENT DOCUMENTS

| | | | | |
|---|---|---|---|---|
| 3,204,805 | A * | 9/1965 | May | 220/257.2 |
| 3,312,368 | A | 4/1967 | Reynolds et al. | |
| 3,338,462 | A | 8/1967 | Reynolds et al. | |
| 3,389,827 | A | 6/1968 | Abere et al. | |
| 3,935,960 | A | 2/1976 | Cornell | |
| 3,951,316 | A | 4/1976 | O'Neal | |
| 4,068,449 | A | 1/1978 | Harper | |
| 4,114,778 | A | 9/1978 | O'Neal | |
| 4,243,156 | A | 1/1981 | Lobbestael | |
| 4,318,490 | A | 3/1982 | Schneider | |
| D283,983 | S | 5/1986 | Fellows et al. | |
| 4,589,569 | A | 5/1986 | Clements | |
| 4,595,114 | A | 6/1986 | Lu | |
| 4,609,123 | A | 9/1986 | Poncy | |
| 4,749,100 | A | 6/1988 | Eberhart | |
| 4,853,267 | A | 8/1989 | Lu et al. | |
| 4,895,270 | A | 1/1990 | Main et al. | |
| 4,927,048 | A | 5/1990 | Howard | |
| 5,108,003 | A * | 4/1992 | Granofsky | 220/257.2 |
| 5,119,955 | A * | 6/1992 | Granofsky | 220/270 |
| 5,645,191 | A | 7/1997 | Neville | |
| 5,692,616 | A | 12/1997 | Baker | |
| 5,813,559 | A | 9/1998 | Cho | |

(Continued)

FOREIGN PATENT DOCUMENTS

GB 2156772 A * 10/1985

*Primary Examiner* — Mickey Yu
*Assistant Examiner* — Robert J Hicks
(74) *Attorney, Agent, or Firm* — Pearl Cohen Zedek Latzer, LLP

(57) ABSTRACT

A sanitary, protective barrier covering, which is attachable to lids that accompany beverage containers/cups, particularly disposable containers for coffee or other hot beverages. The sanitary barrier comprises a thin flexible strip of material that covers the entire area on which consumers place their mouths. It is adhered to the lid with a light, food grade adhesive. The sanitary barrier has an extended pull tab that is not adhered to the lid and extends beyond the bottom wall of the lid and can be easily gripped to allow the strip to be pulled up and away from the lid for easy removal of the sanitary barrier.

18 Claims, 15 Drawing Sheets

U.S. PATENT DOCUMENTS

| | | | | |
|---|---|---|---|---|
| 5,813,561 | A | 9/1998 | Chang et al. | |
| 6,129,268 | A | 10/2000 | Stahlecker | |
| 6,443,323 | B1 | 9/2002 | DeRose | |
| 6,450,359 | B1 | 9/2002 | Chang et al. | |
| 6,578,723 | B1 | 6/2003 | Tyner | |
| 6,899,244 | B2 | 5/2005 | Takayama | |
| 7,111,749 | B1 | 9/2006 | Akers | |
| D537,717 | S | 3/2007 | Notarianni | |
| 7,191,911 | B2 | 3/2007 | O'Neill | |
| 2002/0088802 | A1* | 7/2002 | DeRose | 220/258.2 |
| 2003/0146217 | A1* | 8/2003 | Takayama | 220/254.1 |
| 2005/0139597 | A1* | 6/2005 | O'Neill | 220/254.1 |

* cited by examiner

SANITARY BARRIER FOR BEVERAGE CONTAINER LID

CROSS REFERENCE TO RELATED APPLICATION

This application claims the benefit under 35 U.S.C. §119 (e) of U.S. Provisional Patent Application No. 61/068,497, filed Mar. 7, 2008, which is hereby incorporated herein in its entirety.

BACKGROUND OF THE INVENTION

This invention relates to sanitary coverings for beverage lids, particularly those used on and applied to disposable cups and particularly for lids that are placed on cups containing hot beverages such as coffee, tea or hot chocolate. The present invention also relates to an add-on sanitary barrier for a beverage lid of any design, which barrier can be applied after manufacture of such lid and does not to interfere with the traditional stacking or packaging of such lids. Although it is not limited to any particular application, the preferred use would be to cover a beverage lid with a pre-formed drinking aperture.

It is widely believed that human hands are the leading cause of the spread of communicable diseases. People who serve coffee and other beverages having disposable lids typically do not wear gloves, often also handle money, and may not otherwise observe sanitary food service practices. The present invention addresses consumers' concerns that the portion of the beverage lid on which consumers place their mouths has been in direct contact with another person's bare hands or has been otherwise contaminated.

The use and design of various disposable beverage lids is well known in the prior art. The prior art teaches various forms of tamper proof coverings for cans, containers or the like and various permutations on preventing spillage of the beverage in the container, but none teaches an effective sanitary covering for disposable beverage lids. The prior art teaches various coverings for cans to prevent contamination that typically occurs at various stages in the manufacturing, shipping and storing stages and there are many designs for beverage lids and methods of preventing spillage of a beverage. There have also been many attempts at providing a method of detecting tampering.

For example, U.S. Pat. No. 4,895,270 to Main et al. teaches an attachment with a rupturable membrane for a pop-top beverage container, with a weak membrane and elastic covering that stretches over the entire top of the container. Unlike the present invention, this product is for a container and not a removable lid and is intended to prevent contamination of the beverage contents. This product also interferes with the stacking of the product on which it is intended to be used, and this product is different than the disposable lids for which the present invention is invented. Also, it uses much more material and cannot be used for the disposable beverage lids for which the present invention is intended.

Similarly, U.S. Pat. No. 4,927,048 to Howard teaches an aluminum foil covering for pop-top cans, which covering remains attached to the can and covers the top of the container. This covering is intended to remain attached to the container, covers the entire top, not just the mouth contact area, and does not contemplate or provide a solution for disposable beverage lids.

U.S. Pat. No. 5,692,616 to Baker discloses a protective sheet that covers the entire top and bottom of the lid with a perforated section that allows the sheet to be torn once placed on a cup rim and then pulled through a hole by the user once it has been placed on a beverage container. There are several drawbacks to this invention. First, any microorganisms on the bottom protective sheet will contaminate the beverage on which the lid is placed, whether because of agitation or whether the beverage splashes up against the sheet or otherwise. Second, this invention requires significant material and a complex manufacturing process. Third, the removal process requires that the sheet be agitated and, because the sheet will change form as it constricts to be pulled through the hole in the lid, any dust or other dirt thereon will be caused to fall into the beverage that is being consumed.

U.S. Pat. No. 6,129,268 to Stahlecker teaches a cover for the top of a container that already has a sealed opening, where beverage contents are discharged on top of the container beyond the previously sealed opening. This invention does not contemplate or teach the same means for covering the container mouth area as does the present invention, where beverage contents are discharged directly from a drinking aperture into a consumer's mouth.

U.S. Pat. No. 6,443,323 to DeRose teaches a protective seal for pop tab type cans that fastens a seal to the tab opener and can be swiveled to the side once removed by the user. This design is not removable by the user, is only for pop tab type cans and is intended to prevent tampering at the point of manufacture.

U.S. Pat. No. 6,899,244 to Takayama describes a method of preventing tampering, whereby, once a pop-top container has been used, the container is prevented from being reused as a new container.

U.S. Pat. No. 7,111,749 to Akers discloses a cover piece for coffee cup lids that uses a flat piece to essentially cover the preformed hole for a mouthpiece that can be removed by the user with his or her thumb and forefinger. This piece does not provide any sanitary prevention and is only designed to prevent spillage, as are other lid designs with various methods of covering the drinking hole. Moreover, the application of this piece to a lid by a server or consumer, and the removal of such by the consumer, increases the likelihood of contaminating the drinking area.

U.S. Pat. No. 7,191,911 to O'Neill discloses a resealable tab for a drinking cup and a resealable method of covering a drinking hole. However, the resealable tab does not extend far enough around the lid to provide meaningful sanitary protection. Unlike the present invention, the tab is intended to cover only the drinking aperture and nothing more. In addition, placing the resealable tab on other portions of the lid and again placing it over the mouth hole in the manner disclosed may contaminate the mouth area with any microorganisms that previously resided on the region of the lid surface on which it was temporarily placed.

Each of the prior devices discussed above has one or more disadvantages that either prevent it from being easily implemented in the beverage industry or do not accomplish the same objectives as the present invention. For example, the products that apply to soda cans or other metallic cans are not instructive because the process that often leads to their contamination is not applicable to the lids contemplated in the present invention. Most of the lids for which the present invention is created are stacked and packaged in bulk, and thus are not very susceptible to contamination until just before they are placed on a container and served to consumers. None of the prior inventions teaches a practical and cost-effective sanitary method of covering the area on which a consumer places his or her mouth on a beverage container lid.

SUMMARY OF THE INVENTION

It is an object of the present invention to provide a hygienic and sanitary barrier and means for protecting the area of a disposable beverage lid on which a consumer places his or her mouth.

It is another object of the present invention to reduce or eliminate the potential spread of germs and other communicable diseases by giving consumers confidence that the person serving the beverage to him/her has not contaminated the beverage in the process of serving the beverage.

It is a further object of the present invention to teach a new sanitary barrier for beverage lids that allows a consumer to first place the beverage lid on a surface while adding to the beverage or allowing it to cool off, and to then remove the sanitary barrier and to finally place his/her mouth on the lid, knowing that the mouth portion of such lid has not been contaminated by such surface.

It is yet another object of the present invention to provide a sanitary barrier that extends to the center of the top of the lid to also protect the portion of the lid that is touched by the consumer's nose when drinking the beverage.

It is still another object of the present invention to provide an easily disposable and (in at least one embodiment) predominately recyclable sanitary barrier which uses the least amount of material possible to accomplish the objective described herein.

It is yet another object of the present invention to provide some, if not substantial or complete, protection from spillage of the beverage in the container on which the lid is placed prior to the sanitary barrier being removed.

Still another object of the present invention is to provide a cost-effective manner in which lids previously manufactured may be protected by the new sanitary barrier in a cost-effective manner that does not interfere with packaging, storing or shipping methods already in place. Accordingly, a further object of the present invention is to provide a new sanitary barrier for beverage lids that is easy to manufacture and market to consumers.

It is an even further object of the present invention to provide a sanitary barrier that extends beyond the portion of the lid that the user's top lip touches to the top surface of the lid (in various forms and shapes) for the purpose of placing advertisements, promotions or other messages.

It is another object of the present invention to provide a sanitary barrier to the beverage lid that in at least one embodiment, contains a removable game piece or other promotional insert within two layers and can be peeled off from the first layer of the sanitary barrier or which is printed on the top or bottom surface of the sanitary barrier. Similarly, an advantage of the present invention is the ability to provide marketing messages or other advertisements on the top or bottom surface of the sanitary barrier.

The present invention provides a hygienic and sanitary barrier over the surface on which a consumer places his or her mouth and which would, or a consumer would perceive would, without this invention, otherwise contact other unsanitary surfaces (e.g., a server's bare hands). None of the known prior art references discloses, suggests or teaches a novel sanitary barrier for covering a beverage lid as described in the present invention, which is a simple and effective solution to preventing contamination of these types of lids at the point of service and/or use of such lids prior to drinking the beverage.

The present invention provides a barrier between other media that come in contact with the lid prior to the consumption of the beverage in the container it covers (e.g., typically from a server's bare hands or use of a contaminated glove at a coffee shop or other fast food establishment, the user's own hands and a table or other surface on which the lid is placed face down prior to consumption of the beverage), which barrier is easily removed by use of an extended pull tab that is not adhered to the lid. Thus, an advantage of the present invention is to give the consumer the ability to place a disposable beverage lid on a table or other surface without contaminating the lid by exposing the mouth portion of the lid to dirt, germs or other material while doing so.

The present invention teaches a new and novel sanitary covering and method of covering for a lid for beverages—especially lids for disposable cups and particularly those used for coffee, tea or other hot beverages—that may be comprised of a recyclable paper covering with a wax paper or thin flexible material that covers the same portion of the lid that would otherwise be touched by a server's bare hands or fingers (or with a contaminated glove covering such hands), and that would also cover the portion of the lid and extend slightly beyond, on which the user of the lid would place his or her mouth. The application of this invention to a beverage lid will dramatically reduce the potential spread of "germs" and will give the consumer confidence that the person or persons who handle the lid and/or actually serve the beverage to him have not contaminated the lid in the process of serving it. The lid will also provide some protection from spillage of the beverage in the container on which the lid is placed.

This invention provides a physical sanitary barrier between the portion of the lid that has been in contact with unsanitary media and the portion of the lid that a consumer places his or her lips, mouth and/or nose (much like a plastic glove provides the same barrier in other food service activities, although even where gloves are used they are not always kept sanitary). The present invention preferably consists of a flexible thin paper, foil or plastic material that, once applied, is conformed to a disposable beverage lid, can be used for any style of beverage lid and is sealed to such lid by way of a food grade or other light adhesive applied to the sanitary barrier.

Removal of the sanitary barrier of the present invention from the lid may be done by movement in one general direction. Proper removal of the sanitary barrier does not allow any dust, debris or other matter to fall back onto the mouth area of the lid.

The present invention may also have an extended pull tab, which may be of varying shapes, lengths and designs, that the consumer may grip in order to peel the sanitary covering from the beverage lid prior to consumption but after being served, and/or after placing the lid on a table or other surface to modify (e.g., add to) the beverage.

One advantage of extending the sanitary barrier beyond the drinking aperture itself is that the sanitary barrier will provide a larger sanitary area, which is important in certain circumstances, such as if the consumer licks a drop of liquid off of the front of the lid that might otherwise drip off the lid.

Another advantage of extending the sanitary barrier beyond the drinking aperture itself is reduction or even elimination of consumer requests for multiple lids, which often occurs when consumers want to ensure that the lid from which they are drinking has not been contaminated by a server. This significantly increases costs to the companies that use these lids, and therefore the sanitary barrier is a cost-effective solution.

Another advantage is to provide a higher quality product (the beverage) by assuring beverage consumers that they are receiving a clean product (e.g., clean coffee).

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which.

DETAILED DESCRIPTION OF THE INVENTION

While the present invention is capable and susceptible of embodiment in myriad forms, designs and configurations, the drawings and descriptions herein are understood to illustrate the principles of the invention and are not intended to limit the invention to the embodiments so illustrated.

FIGS. 1A-1K show examples of the various types of prior art beverage cup lids that are currently in use and with which the present invention may be used. While each of the prior art lids shown in FIGS. 1A-1K is configured slightly differently, each possesses a slightly raised drinking platform with a drinking aperture formed therethrough.

Figure 1A:
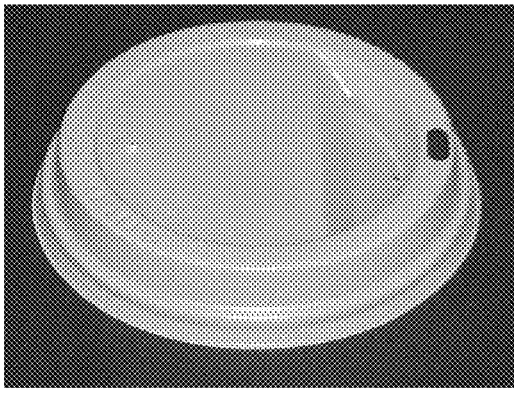
FIG. 1A (PRIOR ART)
FIGS. 1A-1K show examples of the various types of prior art beverage cup lids that are currently in use and with which the present invention may be used.
Figure 1B:
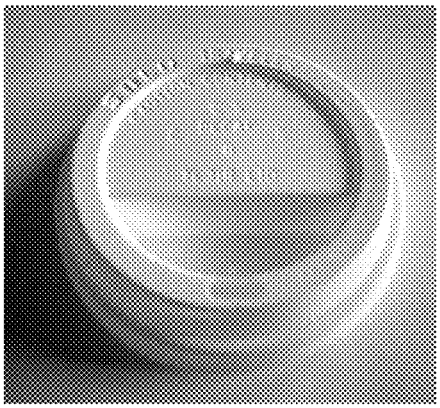
FIG. 1B (PRIOR ART)

FIGS. 1A-1B shows one embodiment of a typical prior art lid 65 for a beverage container. The lid 65 is generally circular and is attached to a beverage container (not shown), which is generally frustoconical or cylindrical in shape and typically has a circular top edge on which the lid may be placed. The prior art container lid 65 has a flat upper platform 37 that is surrounded by a generally circular top rim 40 that is raised slightly with respect to upper platform 37 and through which a relatively small drinking aperture 60, which drinking aperture 60 is typically oval or elliptically shaped, is disposed. At a region about drinking aperture 60 and internal to top rim 40, upper platform 37 ends and is replaced by downwardly angled internal wall 35 and flat lower platform 28, which is lower with respect to platform 37. Top rim 40 intersects at approximately (or slightly greater than) a right angle with an annular side wall 20, which may be angled slightly outward. There may also be a slightly rounded edge 24 at the intersection of the top rim 40 and side wall 20. Below the side wall is typically a mounting portion 16.

Figure 1C:
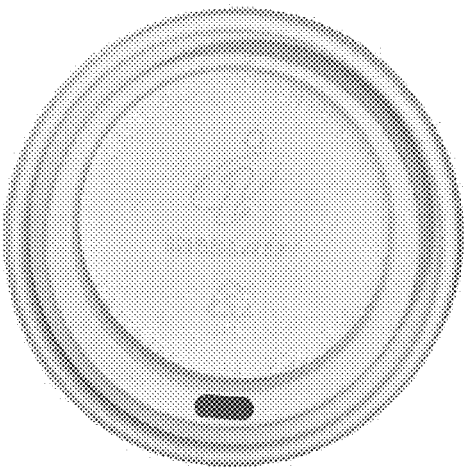
FIG. 1C (PRIOR ART)
Figure 1D:
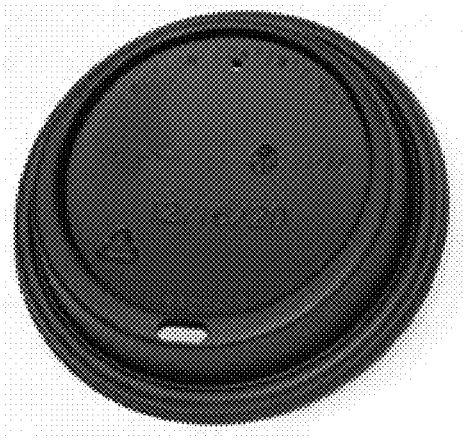
FIG. 1D (PRIOR ART)
Figure 1E:
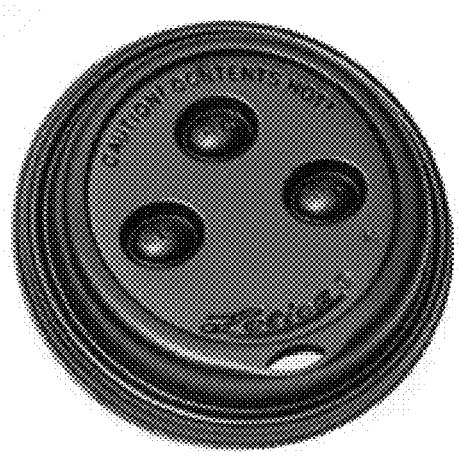
FIG. 1E (PRIOR ART)
Figure 1F:
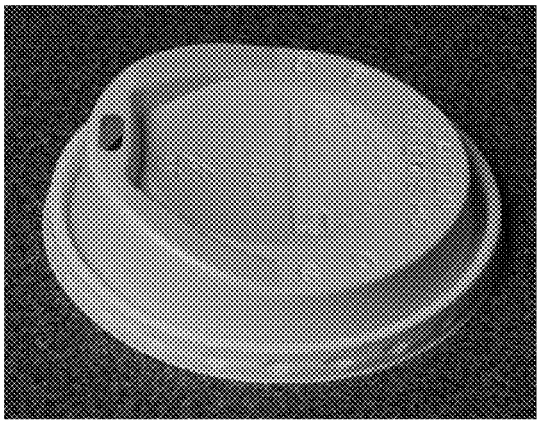
FIG. 1F (PRIOR ART)

FIGS. 1C-1E show another embodiment of a typical prior art lid 65 for a beverage container. This embodiment differs from that of FIGS. 1A-1B in that flat upper platform 37 extends completely across the entire surface of the lid 65 (without the presence of angled internal wall 35 and flat lower platform 28) and is surrounded by a generally circular top rim 40 whose width tapers as it extends circumferentially away from drinking aperture 60.

Figure 2A:
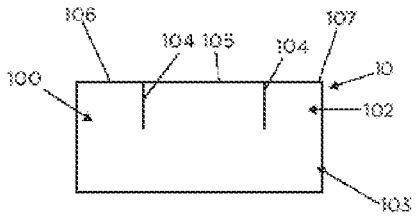
FIGS. 2A-2G show top views of various embodiments of the sanitary barrier described herein, shown unattached to a beverage container lid.

According to a first embodiment of the invention, a sanitary barrier 10 that is to be applied to a lid of a beverage container is shown in FIG. 2A. This embodiment is intended to accommodate easy manufacturing on a flat sheet of material. It should be understood that the general configuration of the sanitary barrier may be modified to fit any and all beverage lid configurations, and no description herein is intended to limit the shape, design, dimensions, angles, materials or application of the invention. Moreover, the sanitary barrier 10 can be transparent, translucent, or of any other combination, shade, color or texture. Although it is intended to be made from a thin, flexible material, the sanitary barrier 10 of the present invention may be made in a sturdier form, such as a thermoplastic, to be attached as described herein and shown generally in the accompanying figures.

FIG. 2A shows a two-dimensional (flat) view of the barrier 10, which in this embodiment is a rectangular sheet 100 having a generally elongated upper portion 102 and a generally elongated lower portion 103. Slits 104 are disposed downward from the top edge of barrier 10 at least partway through sheet 100 to form generally rectangular-shaped tabs from elongated upper portion 102. In the embodiment shown in FIG. 2A, there are two (2) slits 104, which divide elongated upper portion 102 into three tabs 105, 106 and 107.

Figure 2B:
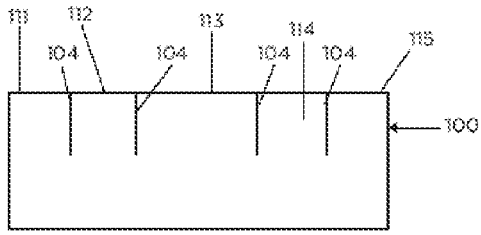

In alternative embodiments, there could be fewer or more slits 104 to divide elongated upper portion 102 into fewer or more tabs, as desired. In these alternate embodiments, rectangular sheet 100 could be less or more elongated as desired, so as to change the dimensions of the tabs, as desired. For example, as shown in FIG. 2B, four (4) slits 104 divide elongated upper portion 102 of sheet 100 into five tabs 111-115.

The bottom side of sheet 100 preferably has adhesive applied to specific portions thereof to allow sheet 100 to be adhered to the lid for a beverage container. It is preferred that a light adhesive be used on the bottom surface of sheet 100 so as not to leave any residue on lid 65. In certain embodiments, only the outer edges of the bottom surface of middle tab 105, which is the tab that covers the preformed drinking aperture 60, has adhesive applied, so as to prevent any adhesive residue from entering the drinking area of the lid.

In order to apply the sanitary barrier 10 to a beverage container lid 65, such as shown in FIGS. 1A-1B or in FIGS. 1C-1E, elongated lower portion 103 of sheet 100 is wrapped around and adhered against the front of the annular side wall 20, centered on the axis of the center of the drinking aperture 60 and extending circumferentially around an arcuate portion of annular side wall 20. Next, middle tab 105 is pivoted forward and folded downward over top rim 40 and over drinking aperture 60 and adhered against top rim 40, and then side tabs 106,107 are pivoted forward and folded downward over and adhered against top rim 40. In this embodiment, because annular side wall 20 top rim 40 are both arcuate in shape, when side tabs 106,107 are folded downward over top rim 40, the inside edges of side tabs 106,107 slightly overlap the respective side edges of middle tab 105. Alternatively, side tabs 106,107 can first be folded downward over top rim 40, and then middle tab 105 is folded downward over top rim 40 and over drinking aperture 60. In this alternate application of sheet 100 to lid 65, the two side edges of middle tab 105 slightly overlap the respective inside edges of side tabs 106, 107.

When so applied to a beverage container lid 65, such as shown in FIGS. 1A-1B or in FIGS. 1C-1E, sheet 100 is intended to cover the portions of a beverage container lid on which a user would place his or her mouth when drinking from the beverage container through the lid 65. Thus, elongated lower portion 103 of sheet 100, which is adhered against the front of the annular side wall 20 covers the area that is touched by user's bottom lip, and side tabs 106,107 and middle tab 105 cover the area that is touched by the user's top lip. Thus, the portions of a beverage container lid on which the user would place his or her mouth are generally protected from actual or perceived contamination.

In order to allow the tabs to be more easily pivoted forward and folded downward over top rim 40, sheet 100 could also have a scored line 110 that divides elongated upper portion 102 from elongated lower portion 103, as shown in FIG. 2B. Thus, tabs 111-115 are folded along scored line 110.

In order to remove the sanitary barrier 10 from beverage container lid 65 to allow the user to drink from the container, the user simply grasps sheet 100 at one of its edges or corners and pulls sheet 100 off lid 65. It is preferred that the user grasp sheet 100 at one of the edges or corners of elongated lower portion 103, as pulling on an edge or corner of elongated upper portion 102 may result in sheet 100 being torn across lower portion 103, due to the presence of slits 104 formed therein.

Figure 2C:
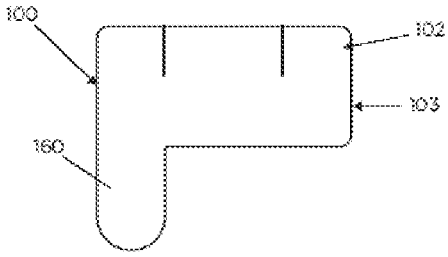

In certain embodiments, sheet 100 also has a pull tab 150 that allows easy removal of the sanitary barrier 10 from the lid 65. The main function of pull tab 150 is to act as an extension from sheet 100 that can be gripped easily by a user's fingers, although different techniques may be used to remove the sanitary barrier from the drinking lid. The pull tab may be any shape and size and may extend from a number of places on sheet 100, such as from elongated upper portion 102 or from lower portion 103. As shown in FIG. 2C, pull tab 150 is preferably an extension that is situated on and projects outward from an edge or corner of elongated lower portion 103 of sheet 100. Pull tab 150 can be gripped and pulled upward by a user to remove the sanitary barrier 10 from the lid 65. Although it is intended to be an extension of the one piece of the sanitary barrier 10, pull tab 150 may be made separately and attached to sheet 100 by a strong adhesive or other means. Pull tab 150 is, in one embodiment, approximately 1 cm wide and 1 cm tall, depending on the shape, but could have other dimensions and should have enough surface area to accommodate gripping by an average person's fingers.

Figure 2D:
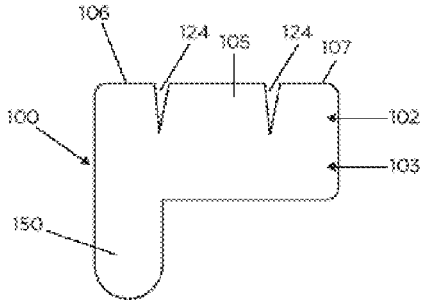

As discussed above, when the barrier 10 embodiment of FIGS. 2A or 2C is applied to a beverage lid 65, such as shown in FIGS. 1A-1B or in FIGS. 1C-1E, either the inside edges of side tabs 106,107 slightly overlap the respective side edges of middle tab 105 or the two side edges of middle tab 105 slightly overlap the respective inside edges of side tabs 106, 107 when middle tab 105 and side tabs 106,107 are folded downward over top rim 40. This can be viewed as a waste of material. In order to avoid this waste, in certain embodiments, as shown in FIG. 2D, slits 104 are not simply slits disposed downward from the top edge of barrier 10 at least partway through sheet 100, but rather are notched to form narrow V-shaped cutouts or notches 124 from upper portion 102. Notches 124 form generally rectangular- or trapezoidal-shaped tabs 105, 106, 107 from elongated upper portion 102.

When the embodiment of the sanitary barrier as shown in FIG. 2D is applied to a beverage container lid 65, notches 124 allow the edges of each tab to be flush or abut against the other tab edges to form a virtually continuous strip across top rim 40, covering at least the mouth area of the beverage container lid. Thus, when sheet 100 is applied to lid 65, such as shown in FIGS. 1A-1B or in FIGS. 1C-1E, and middle tab 105 and side tabs 106,107 are pivoted forward and folded downward over and adhered against top rim 40, the inside edges of side tabs 106,107 do not overlap, and are not overlapped by, the respective side edges of middle tab 105. If the internal angle of narrow V-shaped cutouts 124 is closely matched to the curvature of annular side wall 20 and top rim 40, the inside edges of side tabs 106,107 will abut and rest flush against the respective side edges of middle tab 105 so as to form a virtually continuous strip across top rim 40, covering the mouth area of the beverage container lid. V-shaped notches 124 should be at approximately a 5-10 degree angle, although the angle, number and shape of the notches 124 are not limited to the description herein. In this embodiment, the material of sheet 100 in the embodiment of FIG. 2A or 2C that would have been overlapping, and therefore wasted, is eliminated.

Figure 2E:
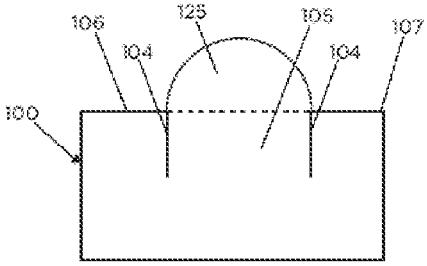

It may also be desirable for sheet 100 to cover certain portions of a beverage container lid, not necessarily proximate to the drinking hole, that may also come into contact with a user's upper lip or that may be touched by a server when handling the beverage lid 65. Thus, in certain embodiments, such as shown in FIG. 2E, sheet 100 has an extension 125, which is attached to and extends upwardly from elongated upper portion 102. In one embodiment, shown in FIG. 2E, extension 125 extends upwardly from the top edge of middle tab 105. In certain embodiments, for example as shown in FIG. 2E, extension 125 may have a generally semi-circular shape, although it may have other shapes as desired or as necessary.

When sheet 100 of FIG. 2E is attached to the beverage container lid 65, such as shown in FIGS. 1A-1B or in FIGS. 1C-1E, extension 125 extends forward towards the flat upper platform 37. When used with the embodiment of beverage container lid 65 shown in FIGS. 1C-1F, extension 125 extends forward over upper rim 40 and over a central part of flat upper platform 37. The extension 125 thus covers the area that would be touched if someone, e.g., a server, were to close beverage container lid 65 by, for example, clamping a finger and thumb on the flat upper platform 37 portion of the beverage container lid 65 shown in FIGS. 1C-1E. When used with the embodiment of beverage container lid 65 shown in FIGS. 1A-1B, extension 125 extends forward over upper rim 40 and onto the inner back side wall 33 of the front, drinking region of beverage container lid 65, thus further securing sheet 100 to the beverage container lid 65 and providing a sanitary cover for the portion of the beverage container lid 65 on which the consumer places his top lip. The extension 125 thus covers the area that would be touched if someone, e.g., a server, were to grab beverage container lid 65 by, for example, clamping a finger and thumb over the mouth portion, i.e., around drinking aperture 60, of the beverage container lid 65 shown in FIGS. 1A-1B.

Figure 2F:
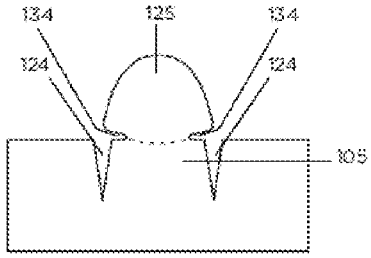

In certain embodiments, particularly when used with the embodiment of beverage container lid 65 shown in FIGS. 1A-1B, as shown in FIG. 2F, extension 125 may have notches 134 on its left and right sides between the extension 125 and the middle tab 105 so as to accommodate the arcuate curve of upper rim 40 and the inner back side wall behind upper rim 40. Alternatively, extension 125 may be slit at the top thereof (e.g., in the shape of a forked tongue, not shown) so as to further accommodate the curvature.

It may also be desirable for sheet 100 to cover the portions of a beverage container lid with which a user's nose may come into contact when drinking from the beverage container through the lid 65. Thus, in one embodiment, shown in FIG. 2G, extension 126 extends upwardly from the top edge of middle tab 105 and is substantially longer than extension 125 so as to extend toward, and to generally cover, the center of the flat upper platform 37 that generally comes into contact with a user's nose when drinking from the beverage lid 65. In certain embodiments, for example as shown in FIG. 2G, extension 126 may have a generally hour-glass shape, although it may have other shapes as desired or as necessary.

In certain embodiments, extension 125 may be removable from middle tab 105, e.g., via a perforated or scored line, so as to be used for additional purposes. On such use is as a game piece. In this embodiment, extension 125 may have indicia on a top or bottom surface thereof, placed there by an advertiser or manufacturer, so that, once removed from middle tab 105, extension 125 functions independently from sheet 100. For example, extension 125 may have advertising thereon or other indicia that allow it to function as a game piece.

Figure 2G:
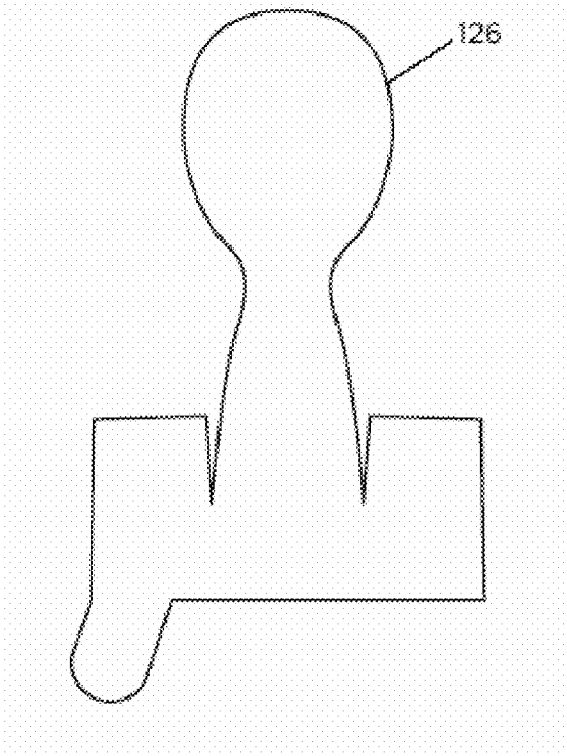

FIG. 2G shows the sanitary barrier of this embodiment, i.e., the sheet 100 of FIGS. 2A-2F, applied to the embodiment of beverage container lid 65 shown in FIGS. 1A-1BC. If the embodiment of FIG. 2C is used, either the inside edges of side tabs 106,107 are slightly overlapping the respective side edges of middle tab 105 or the two side edges of middle tab 105 are slightly overlapping the respective inside edges of side tabs 106,107. If the embodiment of FIG. 2D is used, the inside edges of side tabs 106,107 and the respective side edges of middle tab 105 abut and rest flush against each other. If the embodiment of FIG. 2E or 2F is used, extension 125 is not seen attached to the inner back side wall behind upper rim 40.

When the sanitary barrier is used with an embodiment of the beverage container lid 65 whose annular side wall 20 is perfectly cylindrical, then sheet 100 is preferably substantially straight, i.e., its upper and lower edges are substantially straight lines that are parallel to one another, as in the embodiments of FIGS. 2A-2F. However, in certain embodiments of the beverage container lid 65, annular side wall 20 is angled slightly outward in a conical or frustoconical configuration. In such an embodiment of lid 65, the embodiments of FIGS. 2A-2F will tend to bunch up at the upper edges of sheet 100 when applied to the annular side wall 20, since annular side wall 20 has a smaller arc at its upper edge than at its lower edge.

Figure 3A:
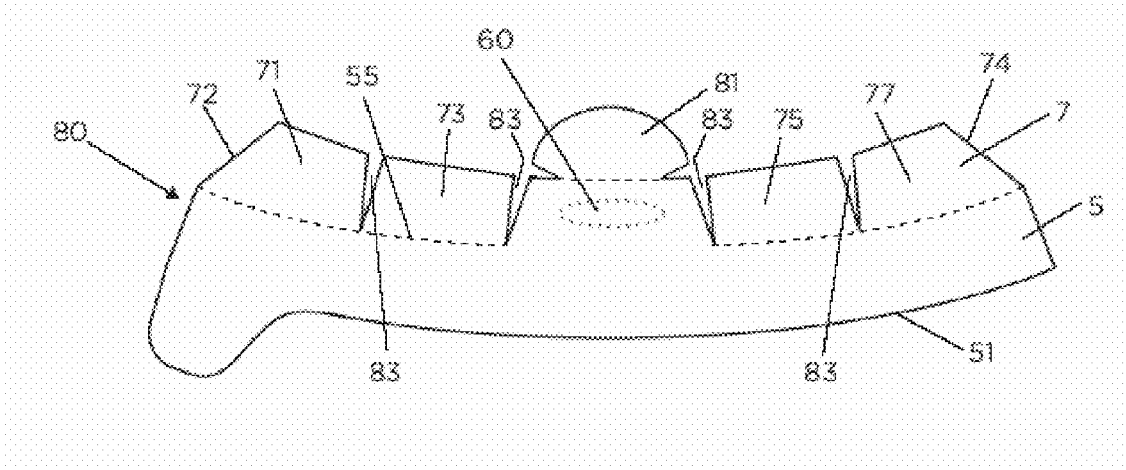
FIGS. 3A-3E show top views of additional embodiments of the sanitary barrier, shown unattached to a beverage container lid.

Accordingly, in order to accommodate this angle, sheet 100 may be curved and may have a slight arcuate shape to follow the curve of the horizontal bottom of the annular side wall 20 and to allow it to be attached evenly to the frustoconical shape of the annular side wall of lid 65. Thus, as shown in FIG. 3A, the sanitary barrier is similar in many respects to the embodiments discussed previously in FIGS. 2A-2F, except that sheet 80 has a curved shape, including curved bottom edge 51, a curved top edge and curved score line 55. In the embodiment shown in FIG. 3A, the left side edge 72 and right side edge 74 of elongated upper portion 102 are at approximately a 50-60 degree angle from the score line 55, although this angle may vary in degree and in shape to fit various lids.

Figure 3B:
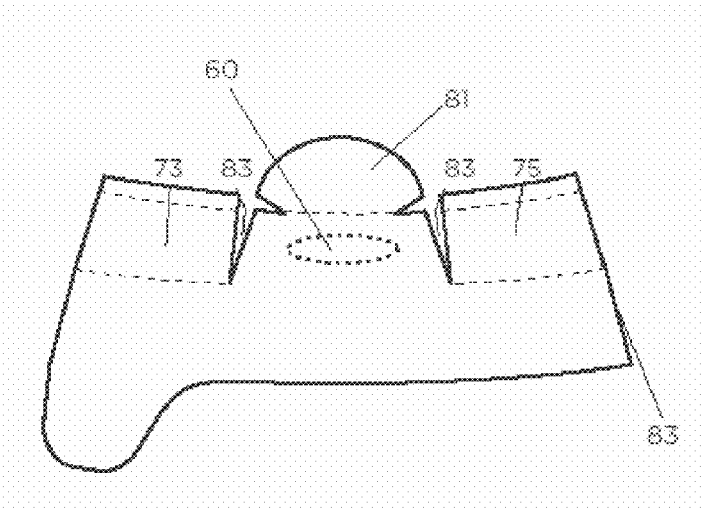

The elongated upper portion 7 generally follows the same arcuate shape as the elongated lower portion 5, and extension 81 from the center tab, shown in FIG. 3B, has generally a semi-circular shape, which covers the portion on which a consumer places his or her top lip and also the portion where someone might grip or press the lid 65 prior to placing it on a beverage container. In this embodiment FIG. 3B, the elongated upper portion 7 of sheet 80 is slit and has narrow V-shaped cutouts 83 in one or more places to accommodate the curvature of the top rim 40, creating generally rectangular- or trapezoidal-shaped tabs 71, 73 and 75, 77 on the left and right sides, respectively, of middle tab, which fold over top rim 40 at score line 55 and generally do not overlap each other or bunch up.

It may be that only three tabs are necessary to cover the mouth area of a beverage cup lid for most consumers. Thus, a shorter version of the embodiment shown in FIG. 3A is shown in FIG. 3B, wherein sheet 80 in FIG. 3B is shorter and covers a smaller arcuate larger portion of the beverage lid top edge 40 on which it is placed than does sheet 80 in FIG. 3A. In this embodiment, sheet 83 has an integral pull tab at a corner thereof, and the extension 81 of the middle tab has notches 134 on its left and right sides between the extension 81 and the middle tab so as to accommodate the arcuate curve of upper rim 40 and the inner back side wall behind upper rim 40. In addition, FIG. 3B also has score lines 76 at the upper most edges of tabs 73, 75 that allow tabs 73, 75 to extend beyond the inner edge of upper rim 40 and adhere to the upper portion of inner back side wall behind upper rim 40. Score lines 76 should contact the inside edge 26 of the beverage container lid.

Figure 3C:
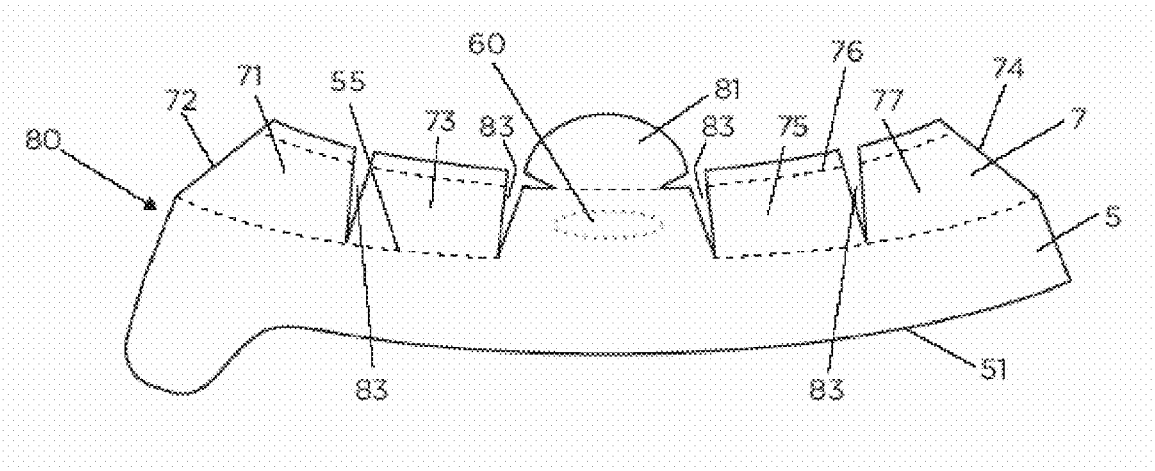

FIG. 3C shows a version of the embodiment shown in FIG. 3A with changes similar to those in FIG. 3B, namely the integral pull tab at a corner thereof, the extension 81 of the middle tab with has notches 134 on its left and right sides between the extension 81 and the middle tab, although it adds score lines at the upper most edges of tabs 71, 73, 75 and 77 that allow tabs 71, 73, 75 and 77 to extend beyond the inner edge of upper rim 40 and adhere to the upper portion of inner back side wall 33 behind upper rim 40.

In each of the embodiments shown in FIGS. 2-3, the height of each of the barriers between elongated upper portion 102 and the elongated lower portion 103 is approximately 1 cm but may vary depending upon the lid on which it is to be placed. In the embodiments shown in FIGS. 3B and 3C, however, while tabs 71, 73, 75, 77 may be approximately 1 cm in height, they consist generally of two vertical sections, separated by score line 76. The lower vertical portion of each of tabs 71, 73, 75, 77 covers a top rim 40 and measures approximately 0.7 cm in height, and the upper vertical portion of each of tabs 71, 73, 75, 77 measure approximately 0.3 cm and are folded downward along the inner back side wall 33 of the top rim 40. The relative heights of the two vertical sections of tabs 71, 73, 75, 77 may be other than those described here.

Although the surface covered by the sanitary barrier shown in the embodiment in FIGS. 3A and 3C may extend beyond the area on which the average consumer's mouth will contact the beverage lid, the measurements thereof may be reduced proportionately to cover a smaller area of the beverage lid and to eliminate any extraneous materials. It is intended that the embodiments shown herein may be modified to fit any of the other prior art lids contemplated herein, or any other beverage lid for which this invention and a sanitary barrier applies or may be applied.

Figure 3D:
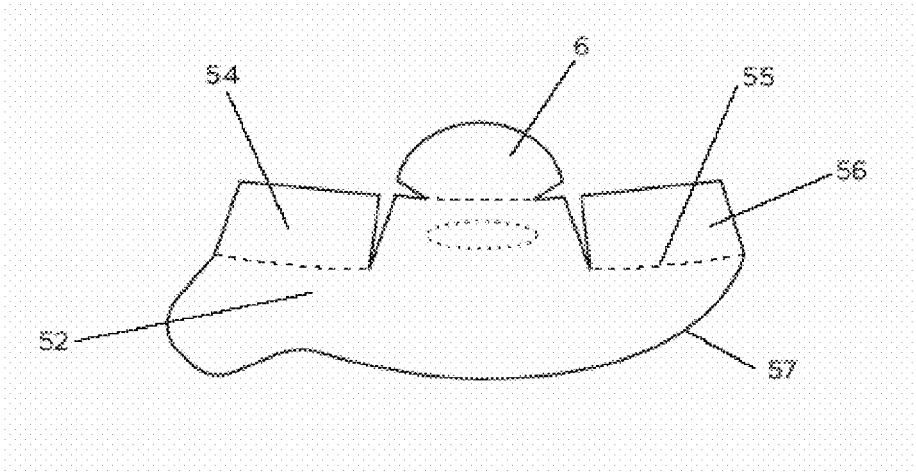
Figure 3E:
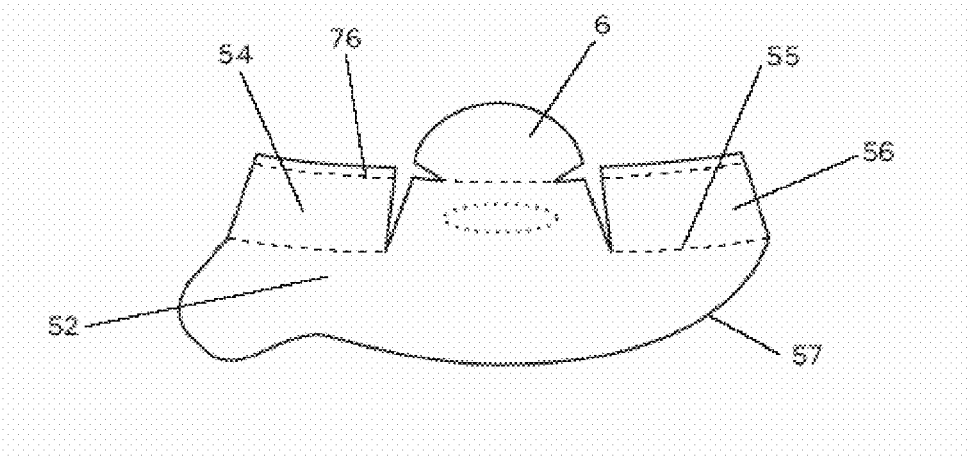

In certain other versions, the elongated lower portion may become progressively narrower from the center portion to the far edges. Thus, the lower edge will not be even with the bottom curvature of the annual sidewall of a beverage container lid, but rather will form a semi-ovular shape along the sidewall. This embodiment is more tailored to the shape of a consumer's bottom lip than the previously-described embodiments and thus does not use as much material as is used in the previously-described embodiments. FIGS. 3D and 3E show generally the same configuration as FIG. 3B, but wherein the lower portion 52 is shorter and has its bottom edge 57 curved upward in an arcuate shape to follow the curve of a consumer's bottom lip. The lower portion 52 of this embodiment is similar to the one described in FIGS. 3A-C, except that the bottom edge 57 in FIGS. 3D and 3E has a smaller radius of curvature than the bottom edge 51 in FIG. 3A. In addition, bottom edge 57 is generally semi-circular in shape, with the left and right edges curving upward to meet score line 55 and the outer edges of the tabs 54 and 56. FIGS. 3D and 3E show pull tab 50 in different configurations. FIG. 3E also has score lines 76 at the upper most edges of tabs 54, 56 that allow tabs 54, 56 to extend beyond the inner edge of upper rim 40 and adhere to the upper portion of inner back side wall behind upper rim 40.

Figure 4A:
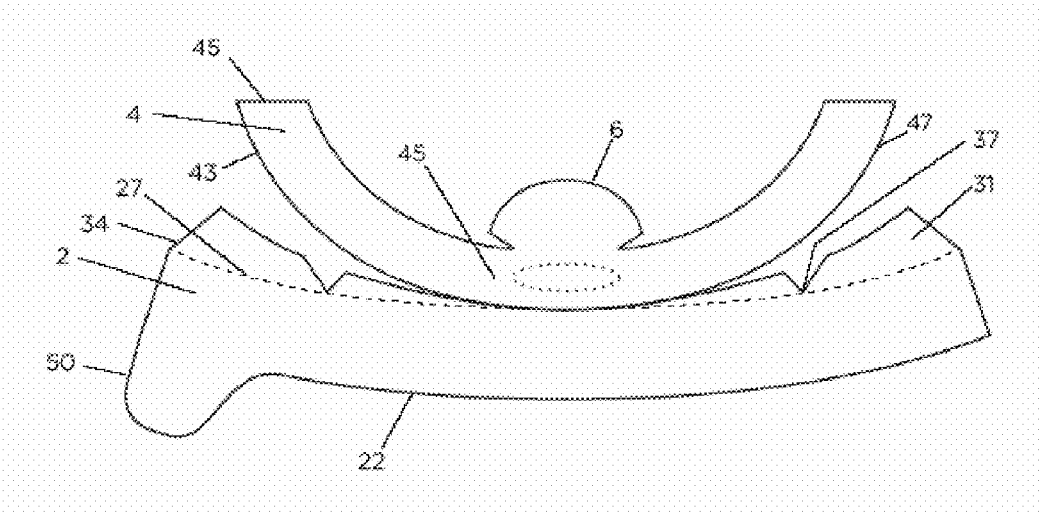
FIG. 4A is a top view of a further embodiment of the sanitary barrier, shown unattached to a beverage container lid.

Another embodiment of the sanitary barrier, as shown in FIG. 4A, a top or upper arcuate strip 4 has a left arm 43 and a right arm 47 and a center portion 45 from which the left arm 43 and right arm 47 extend. The upper strip 4 generally covers at least the area of a beverage container lid that is touched by a drinker's lips and mouth. The center portion 45 of upper strip 4 covers the pre-formed aperture or drink opening 60 of the beverage lid, the approximate location of which is shown in broken line in FIG. 4A.

Attached to the center portion 45 of upper strip 4 is a bottom or lower strip 2. Although the upper strip 4 and lower strip 2 are described separately and may even be manufactured as two pieces, the preferred embodiment is manufactured, as described herein, as a one-piece article. In this preferred embodiment, upper strip 4 and lower strip 2 are joined at region 46, which is essentially a portion of the sanitary barrier 10 that is shared by both upper strip 4 and lower strip 2. Lower strip 2 extends from left to right, substantially under arcuate arms 43 and 47 and has a left arm 13 and a right arm 15.

When the sanitary barrier 10 is used with an embodiment of the beverage container lid 65 whose side walls are cylindrical, then the lower strip 2 is substantially straight, i.e., its top and bottom edges are substantially straight lines that are parallel to one another. However, in the embodiment of the beverage container lid 65 whose annular side walls are angled even slightly, as shown in FIG. 4E, the lower strip 2 generally has an arcuate shape to allow the lower strip to attach evenly to the frustoconical shape of the annular side wall of lid 65. As shown in FIG. 4A, the bottom edge 22 of the lower strip 2 is curved and is slightly concave (i.e., less than 180 degrees) to follow the curve of the horizontal bottom of the annular side wall 20 of lid 65 once the sanitary barrier 10 is attached to lid 65. In other embodiments, shown in FIGS. 3D, 3E and 4C, the bottom edge of the lower strip is curved at a greater angle, i.e., at a smaller radius of curvature, than is the bottom edge 22 shown in FIG. 4A, such that the left and right corners of the lower strip in those embodiments meet the respective score line 27.

In one embodiment, the lower strip 2 has top rim fusing portion 31, which are small portions that extend upward from each of left and right arms 13,15 of lower strip 2. Top rim fusing portions 31 are intended to allow attachment or "fusing" of left arm 43 and right arm 47 of upper strip 4 to left arm 13 and right arm 15, respectively, of lower strip 2 during attachment of sanitary barrier 10 to lid 65, as shown assembled and attached in FIGS. 4D and 4E. The lower strip 2 is divided into two vertical portions, a lower strip side wall portion 25 (i.e., the portion of the lower strip from the dotted line 27 to the bottom edge of the sanitary barrier 10), which has left arm 13 and right arm 15, and top rim fusing portion 31. The division of the lower strip side wall portion 25 and the top rim fusing portion 31 is shown by score line 27, which follows the intersection of the side wall and top rim of the lid.

Score line 27 also illustrates where the top rim fusing portions 31 will be folded forward over the top rim 40 of lid 65 to attach to, or fuse with, upper strip 4 during the attachment to lid 65, as described below. Preferably, line 27 should follow the same arc curvature as circular edge 24 of lid 65, where top rim 40 and side wall 20 intersect. Thus, the top rim fusing portions 31 will generally be in an arcuate shape that generally will have the same curvature as the bottom edge 22 of the lower strip 2, although it may have other shapes and configurations than those shown here. The bottom left and right corners of the lower strip in one embodiment are generally right angles.

In one embodiment, the outer edge 34 of the top rim fusing portion 31 is angled inward from the bottom portion of the lower strip 2 so that, when the top rim fusing portion 31 is folded over the top rim 40, the outer edge 34 will meet up evenly with the far edge 44 of the upper strip 4 (on both the left and right sides). This top rim fusing portion 31 should begin at the axis point of the upper strip 4 and the lower strip 2, and its surface area should increase as it extends away from the center of the strips 2,4, although other shapes and designs may be used to accomplish the fusing of the upper strip 4 with the top rim fusing portions 31. As shown by example in FIG. 4E, the top rim fusing portion 31 should be approximately half of the surface area of the upper strip 4. It is intended that the upper strip 4 and the lower strip 2 should be adhered or fused to each other. In certain embodiments, there is an overlap that does not allow exposure of the rim 40 of the lid 65, such that the adhesion or fusion of the upper strip 4 and the lower strip 2 may be in any manner or structure, such as a wavy line, tabbed or notched extensions 31 above the dotted line 27 (as shown in FIGS. 4A and 4E), or any other manner that allows the pieces to be assembled as one and to be removed as one piece.

In one embodiment, there is folding over or bunching of the material of top rim fusing portions 31. In another embodiment, notches 37 prevent folding over or bunching of any material used in top rim fusing portions 31 and allow top rim fusing portions 31 to use the least amount of material necessary to fuse the upper and lower strips 4,2 together and allow for easy removal. As described below, this prevents the upper and lower strips 4,2 from being separated during removal of the sanitary barrier and will also cover the front edge 24 of the lid so that no portion of the rim (i.e., edge) 24 of the lid near the mouth area is exposed. It should be noted that the angles of the notches 37 may be varied, and some cases there may be overlap among top rim fusing portions 31 and the upper and lower strips 4,2.

In certain embodiments, such as shown in FIG. 4A, extension 6 is attached to and extends upwardly from the upper edge of upper strip 4. Extension 6 has a structure and function similar to that described above with respect to FIGS. 2E and 2F.

Figure 4B:
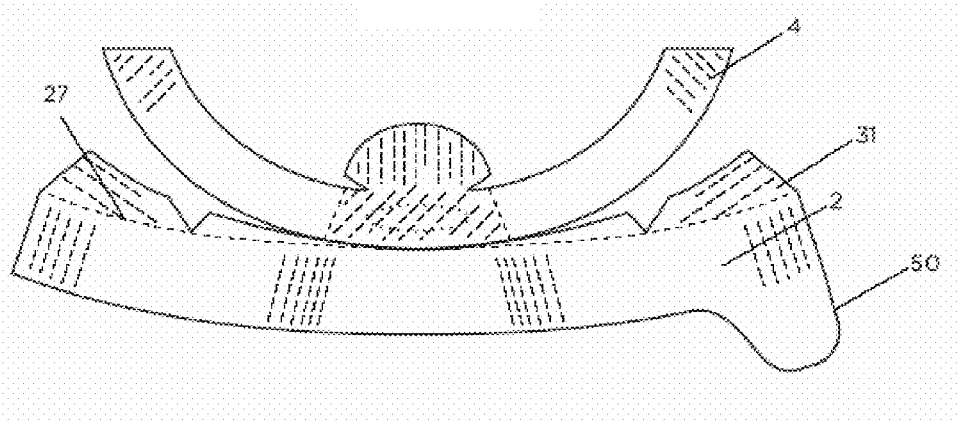
FIG. 4B is a bottom view of the sanitary barrier shown in FIG. 4A, shown unattached to a beverage container lid.
Figure 4C:
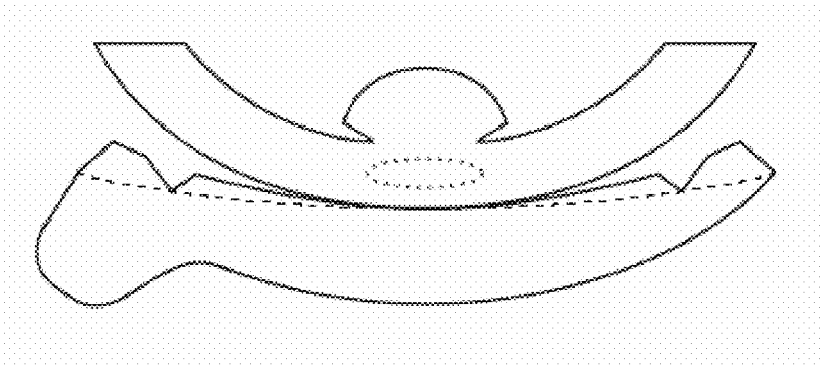
FIG. 4C is a top view of another embodiment of the sanitary barrier, shown unattached to a beverage container lid.

FIG. 4B is a bottom view of the embodiment of the sanitary barrier shown in FIG. 4A, as an example of where adhesive might be applied. As shown in FIG. 4B, the shaded regions show locations where adhesive could be applied so as to allow adherence of sanitary barrier 10 to lid 65, although the application of adhesive is not limited to this description or to the shaded locations shown in FIG. 4B. In one embodiment, adhesive is applied to the bottom surface, i.e., the underside, of bottom strip 2, and on the bottom surface of the portion of upper strip 4 that would lie directly over top rim fusing portion 31 of the bottom strip 2. This creates one piece that is easy to remove. A lighter adhesive or any other method of attachment may be used on the bottom surface of bottom strip 2, and any adhesive or other material used should not leave any residue. In certain embodiments, the bottom surface of center portion 45, which is the part of upper strip 4 that covers the preformed drinking aperture 60, does not have adhesive applied, so as to prevent any residue from being left on or from entering into the drinking area of the lid.

Figure 2H:
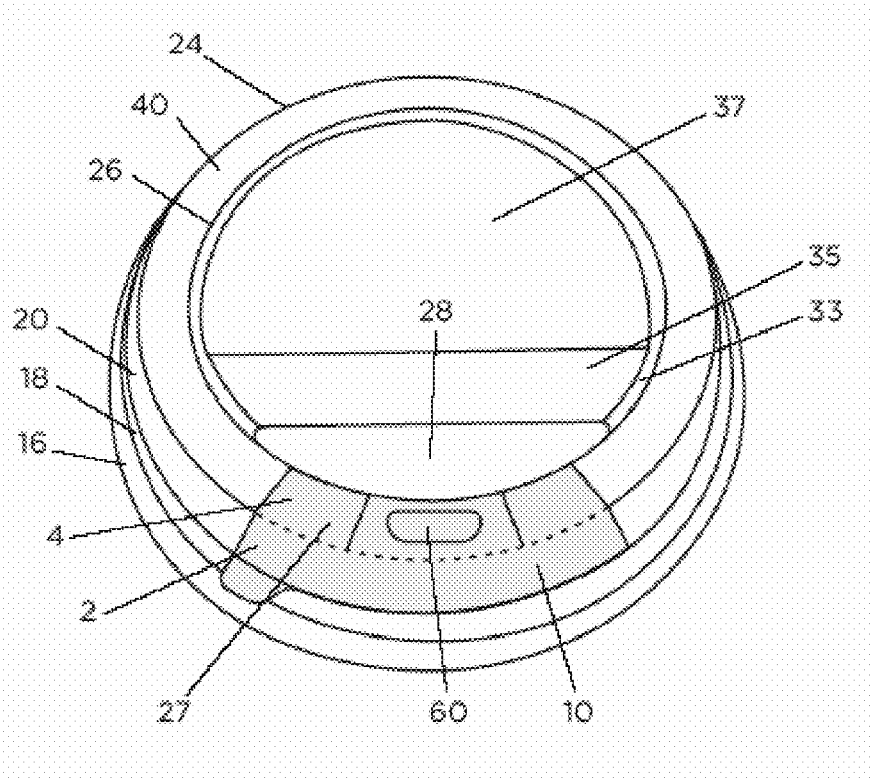
FIG. 2H is a perspective view of a prior art beverage lid fitted with an embodiment of the sanitary barrier.
Figure 4D:
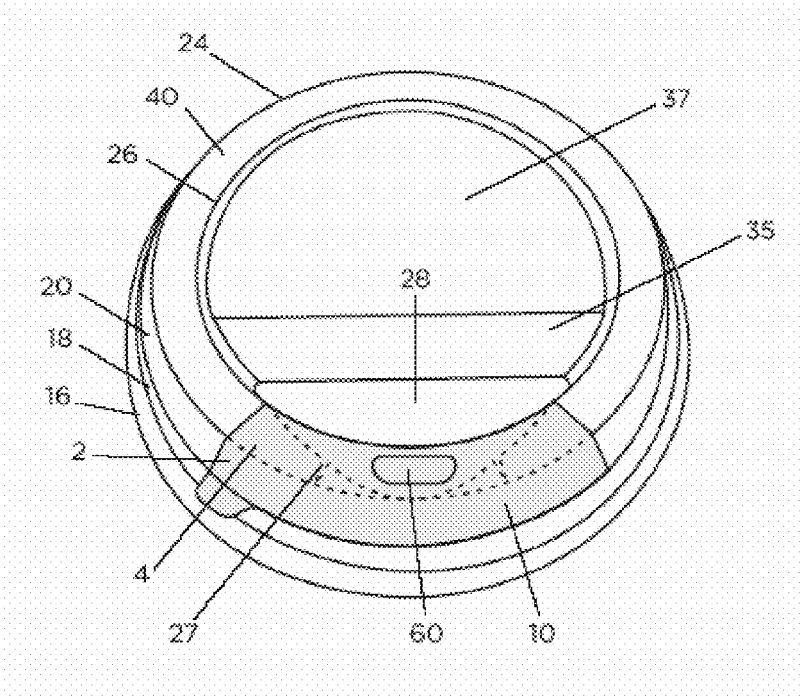
FIG. 4D is a perspective view of a prior art beverage lid fitted with a first embodiment of a sanitary barrier, showing its general configuration and application of covering the front portion of the lid.
Figure 4E:
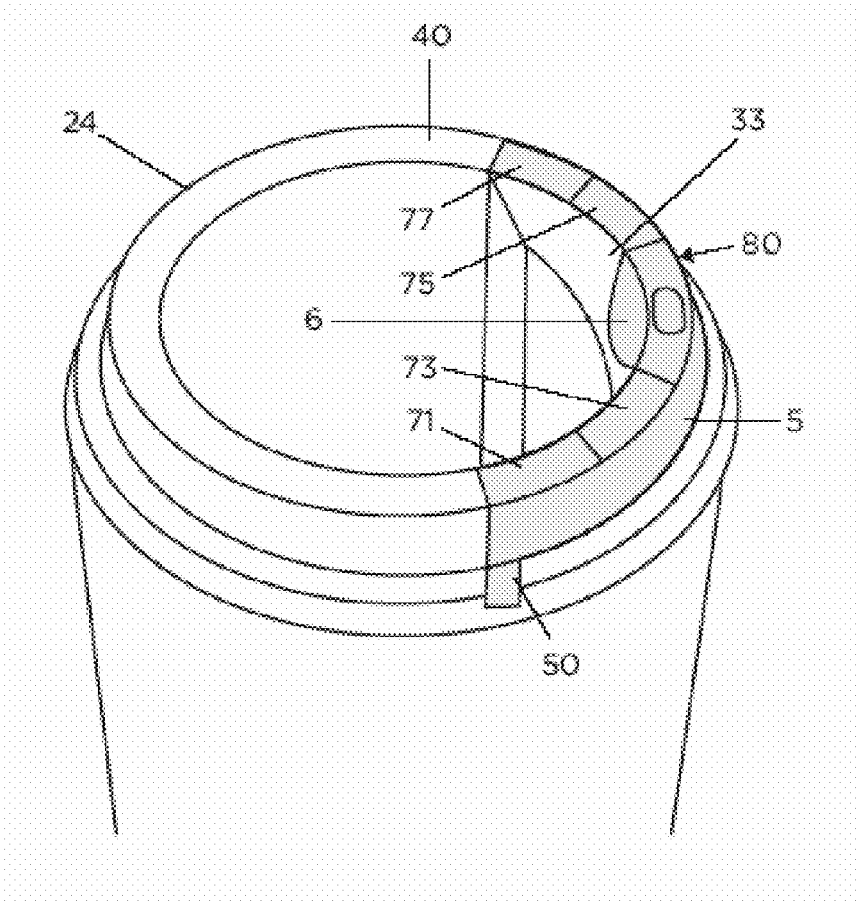
FIG. 4E is another perspective view of a prior art beverage lid fitted with the sanitary barrier shown in FIG. 3A.

In order to apply the sanitary barrier 10 to a beverage container lid 65, the lower strip 2 is wrapped around the front of the annular side wall 20, centered on the axis of the center of the drinking aperture 60 and extending circumferentially around the side wall 20 to approximately the same horizontal plane on which sloped wall 35 begins or ends. Once the lower strip 2 is secured to the annular side wall 20 of the beverage container lid 65, the top rim fusing portion 31 is pivoted forward onto top rim 40. The upper strip 4 is then applied downward onto the top rim fusing portion 31 and the top rim 40 of the beverage container lid 65. Then, extension 6 is pivoted downward over the inside edge 26 of top rim 40 and adhered to the inner back side wall 33, which intersects at approximately 90 degrees with the top rim 40. This application process could also be done by reversing the steps described above. FIGS. 2H and 4D generally depicts how the sanitary barrier would look once applied as described above to a prior art lid 65.

Figure 4F:
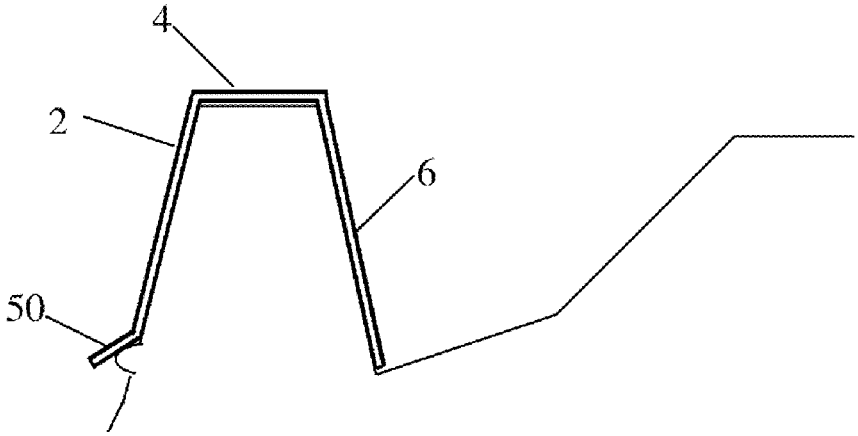
FIG. 4F is a cross-sectional view of the sanitary barrier shown in FIGS. 4D and 4E attached to a prior art beverage lid.

FIG. 4F shows a cross-sectional view of the preferred embodiment of the sanitary barrier 10 attached to a prior art lid 65. The lower strip 2 conforms to the annular sidewall 20, the upper strip 4 conforms to the top rim 40 and the extended portion 6 conforms to the inner back side wall 33 of the beverage container lid 65. It is contemplated that such extended portion 6 may be further extended toward the center of the beverage container lid 65 and follow the slanted wall of the beverage lid to the top surface, which may also be used as an area for the pull tab or may have other media or advertisements printed on the first surface. Such extension may be removed or removable from the remainder of the sanitary barrier (e.g., if such extension has printed material and is used as a coupon).

In one embodiment, the lower strip side wall portion 25 has a height of approximately 1-2 cm, which is the surface area required for most side walls of commercial beverage lids to accommodate a user's bottom lip. Such height may vary depending upon the lid on which it is placed and the bottom portion is generally intended to cover the entire height of side wall 20. For the prior art lid shown in FIG. 4E, the lower strip side wall portion 25 should be approximately 1.1 cm. The configuration of the lower strip shown in FIGS. 4A and 4B is in one embodiment approximately 11 cm wide at the bottom outermost corners, and the configuration of the upper strip shown in FIGS. 4A and 4B is in one embodiment approximately 7.8 cm wide at the outermost corners, although the widths of both the top and bottom strips 4, 2 are not limited to the description herein and may be wider or narrower (i.e., may cover a wider or narrower portion along the circumferential axis of the lid) than is shown here such as in FIGS. 3B, 3E and 4C.

The upper strip 4 is of an arcuate shape that is approximately 0.70-0.75 cm wide along the arc. In the embodiments shown in FIGS. 3A-E, the width of the upper strip is constant throughout its arcuate length. However, in other embodiments, such as in FIGS. 5A and 5B, the width of the upper strip 70 tapers narrower as the strip extends along its arcuate length away from the center of the sanitary barrier in order to accommodate other styles of lids that have a tapering top rim 75. The left arm 43 and right arm 47 of the upper strip can extend from the outer edges of the preformed aperture or drinking hole 60 in a length from 0.5 cm-6 cm (with such length generally intended to correspond to a slightly longer length of the lower strip so that the strips meet at the same point when assembled). In the embodiment shown in FIG. 4A, each arm extends approximately 4 cm in length from the center, so that once the sanitary barrier 10 is applied to a beverage container lid, each arm of the upper strip should fit evenly over the left and right edges of the bottom strip. It is also intended that the top and bottom strips in the embodiment shown here may be reduced proportionately to cover only the area of the beverage container lids on which consumers directly place their mouths, which would be approximately 4 cm wide measured at the widest points on top rim 40 once applied to a beverage container lid.

Figure 5A:
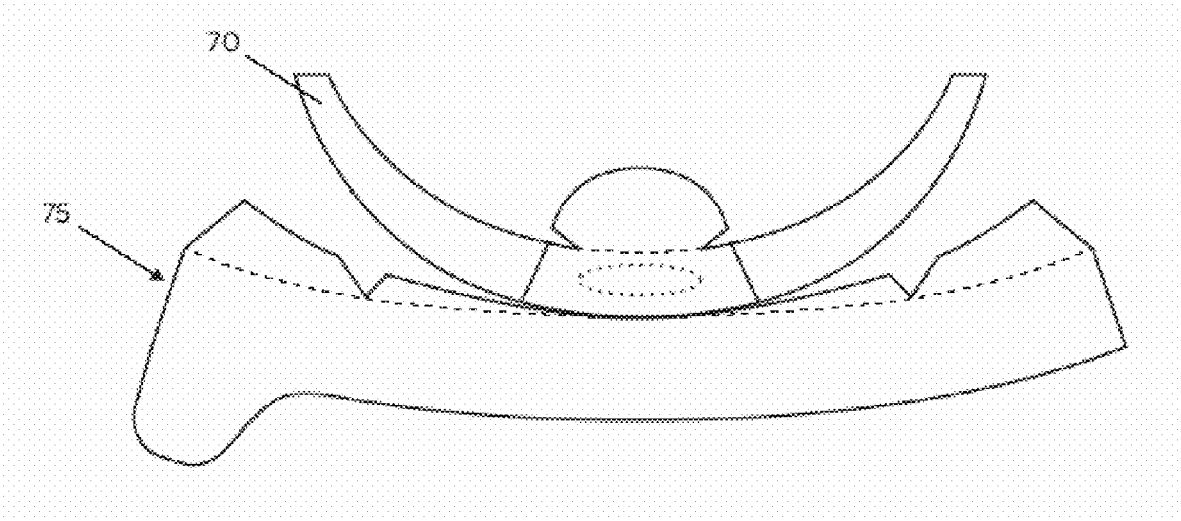
FIG. 5A is a top plan view of another embodiment of the sanitary barrier shown unattached to a beverage container lid.
Figure 5B:
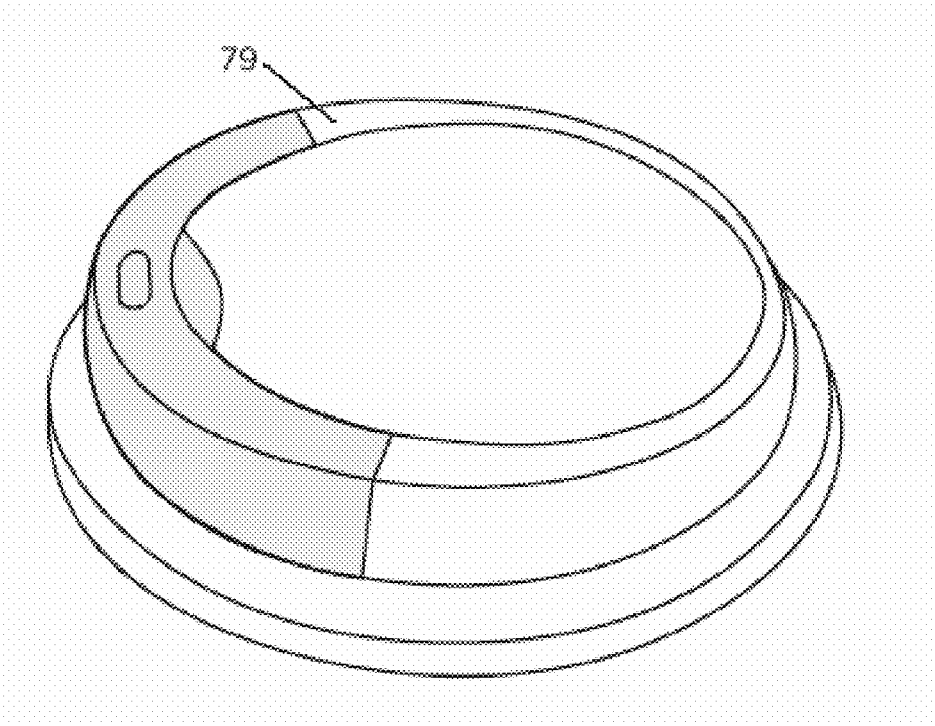
FIG. 5B is a perspective view of a prior art beverage lid fitted with the embodiment of the sanitary barrier in FIG. 5A, showing its application in covering the front portion of the lid.

According to another embodiment of the invention shown in FIG. 5A, which is similar to the first embodiment shown in FIG. 4A, sanitary barrier 75 has a tapering upper strip 70, as compared with upper strip 4, which was of constant width, which is provided for beverage lids with tapering top rim 79, as shown in FIG. 1D and as shown attached in FIG. 5B.

Figure 1G:
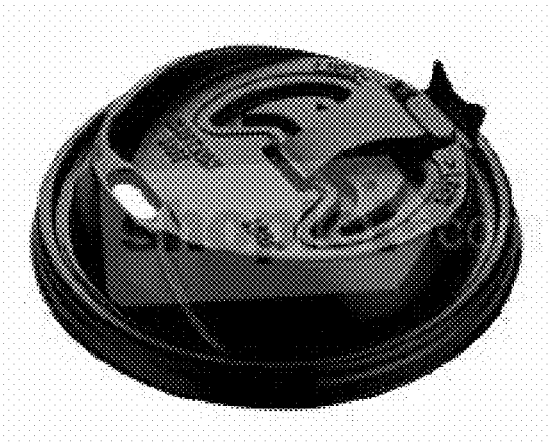
FIG. 1G (PRIOR ART)
Figure 1H:
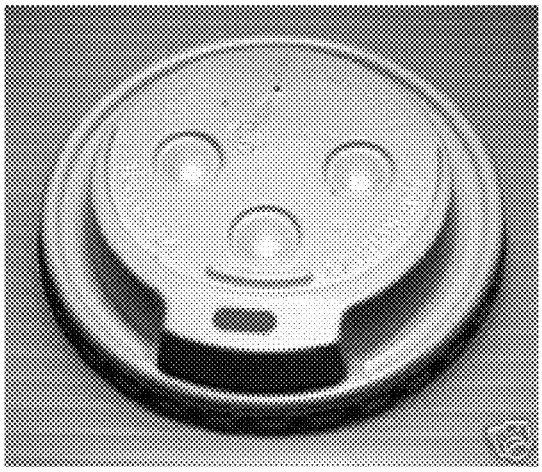
FIG. 1H (PRIOR ART)
Figure 1I:
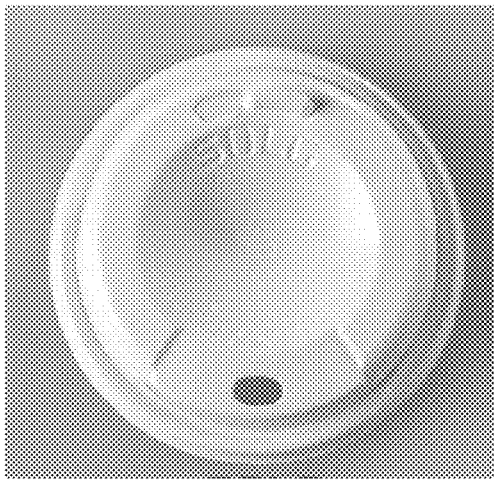
FIG. 1I (PRIOR ART)
Figure 1J:
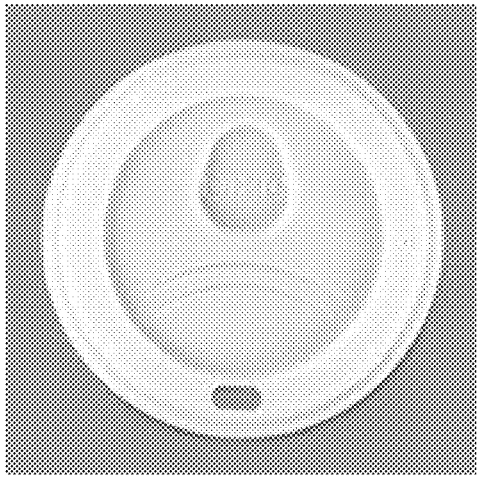
FIG. 1J (PRIOR ART)
Figure 1K:
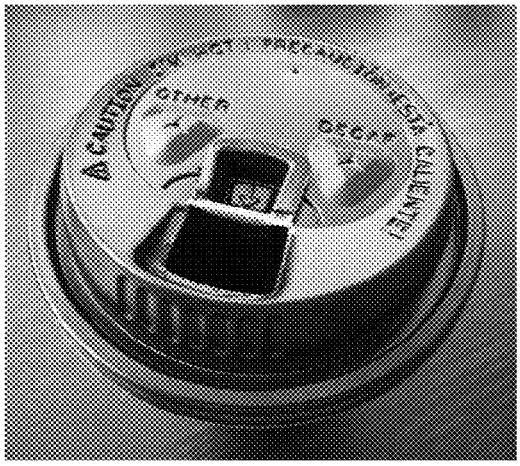
FIG. 1K (PRIOR ART)
Figure 6A:
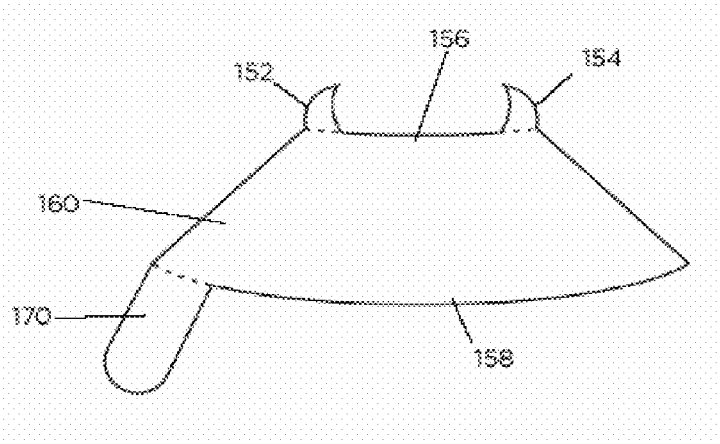
FIG. 6A is a top view of another embodiment of the sanitary barrier for a prior art lid, shown unattached to a beverage container lid.
Figure 6B:
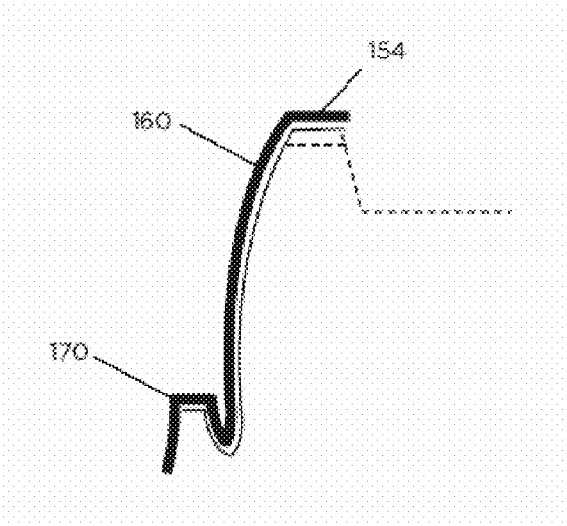
FIG. 6B is a side view of the sanitary barrier shown in FIG. 6A, after assembly and unattached to a beverage container lid.
Figure 6C:
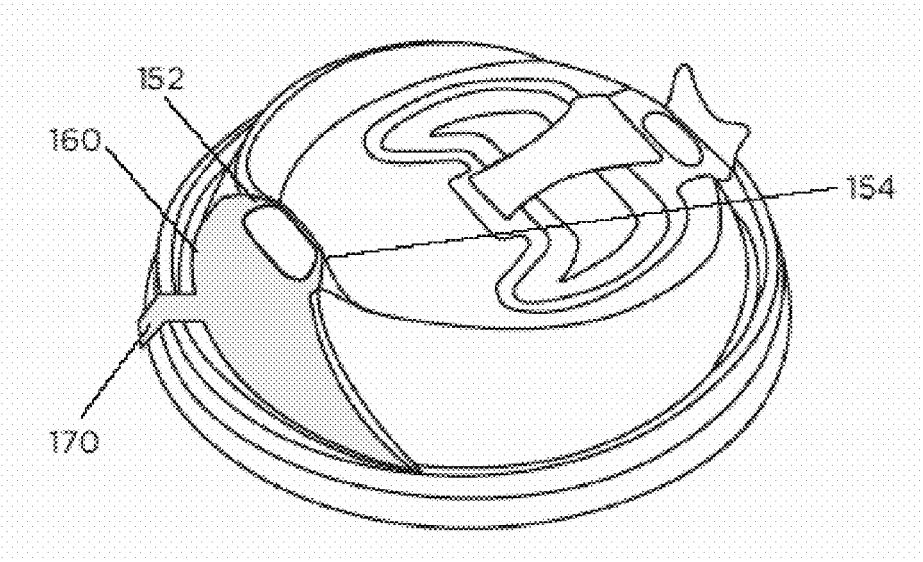
FIG. 6C is a perspective view of the sanitary barrier in FIGS. 6A and 6B, showing its application in covering the front portion of a prior art beverage lid fitted with the sanitary barrier.

According to another embodiment of the invention, shown in FIG. 6A, sanitary barrier 160 has a left tooth 152 and a right tooth 154 extending upward from bottom portion 158, and is provided to accommodate prior art beverage lids shown in FIGS. 1G and 1K, in the manner shown in FIG. 6C. The prior art lid is fitted with a anti-spill mechanism, which is typically in the closed position and thus fits in the aperture for the preformed drink hole but does not extend to cover the mouth portion of the lid. As shown in the side view of FIG. 6B and the perspective view of FIG. 6C, the mouth area of such a prior art lid is intended to be covered. The general depth of the sanitary barrier 160 is approximately 2 cm, and the width of the top edge 156 of the sanitary barrier 160 is approximately 2.5 cm and the bottom edge 158 of the sanitary barrier 160 is approximately 5 cm. Pull tab 170 is shown for easy removal of the sanitary barrier.

Figure 7A:
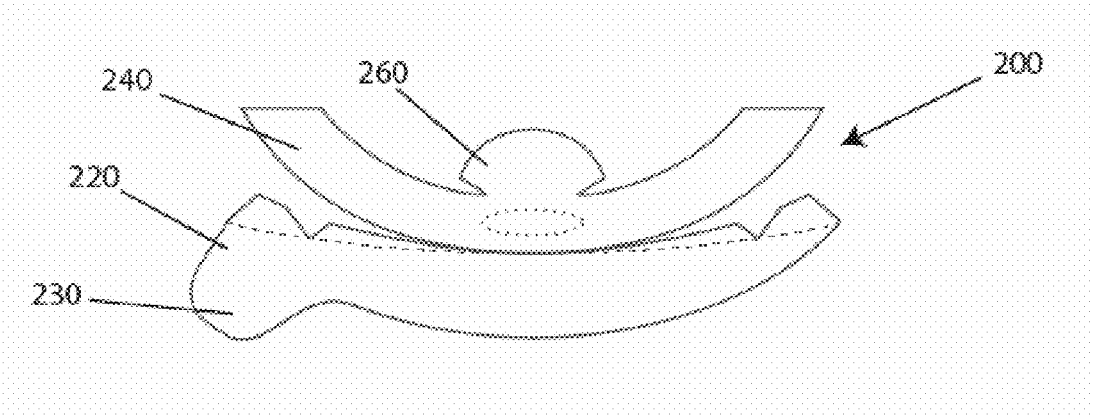
FIG. 7A is a top view of another embodiment of the sanitary barrier, for use with a different prior art beverage lid, shown unattached to a beverage container lid.
Figure 7B:
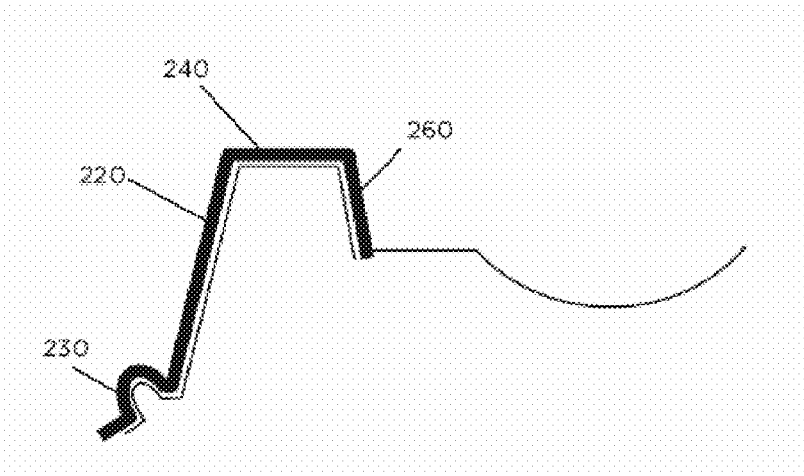
FIG. 7B is a side view of the sanitary barrier shown in FIG. 7A, shown unattached to a beverage container lid.
Figure 7C:
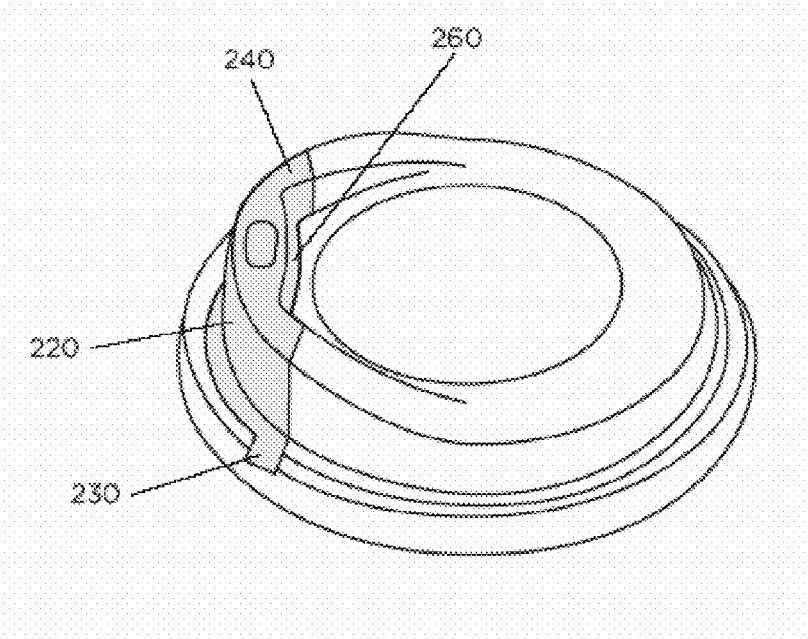
FIG. 7C is a perspective view of a prior art beverage lid fitted with the sanitary barrier shown in FIGS. 7A and 7B, showing its application in covering the front portion of the lid.

According to another embodiment of the invention, as shown in FIG. 7A, provided to accommodate prior art beverage lids shown in FIGS. 1H-1I as shown in FIG. 7C, sanitary barrier 200 fits a prior art lid with a circular top rim that begins to slope down once the top rim's circumference is approximately 4.5 cm wide, and also has a curved center of the top of the beverage lid, as shown in FIG. 7C. In this embodiment of the sanitary barrier, the width from the outer left and right corners of upper strip 240 should be approximately 4.5 cm once assembled, which should be flush with the beginning of the downward slope on such prior art lids. Otherwise, this embodiment is intended to operate in the same fashion as those described above. Extended piece 260 is shown in FIG. 7A as a semi-circular shape, but it may be curved to match the arcuate shape of upper strip 240, in which case it should be slit inward on each end by 1-2 cm to avoid bunching of any material. The lower strip 220 is similar to the one described in FIGS. 1-3, and similarly there is an extended pull tab 230 for easy removal of the sanitary barrier.

FIG. 7B shows a cross-sectional view of an embodiment of the sanitary barrier 200 of FIG. 7A attached to prior art lid shown in FIGS. 1H and 1I. The lower strip 220 conforms to the annular sidewall, the upper strip 240 conforms to the top rim, and the extended portion 260 conforms to the inner back side wall of the beverage container lid. Pull tab 230 is shown wrapped around the mounting portion of the beverage container lid, although it may also extend directly from the sidewall of such lid.

Figure 8A:
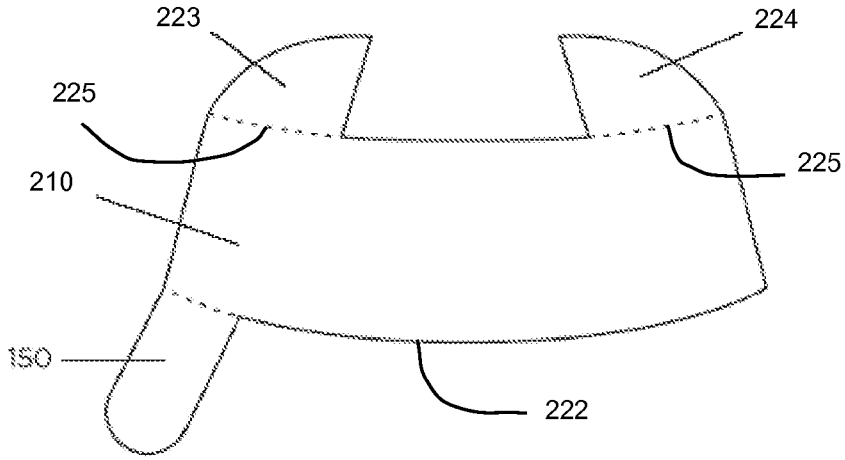
FIG. 8A is a top view of another embodiment of the sanitary barrier, for use with a different prior art lid, shown unattached to a beverage container lid.
Figure 8B:
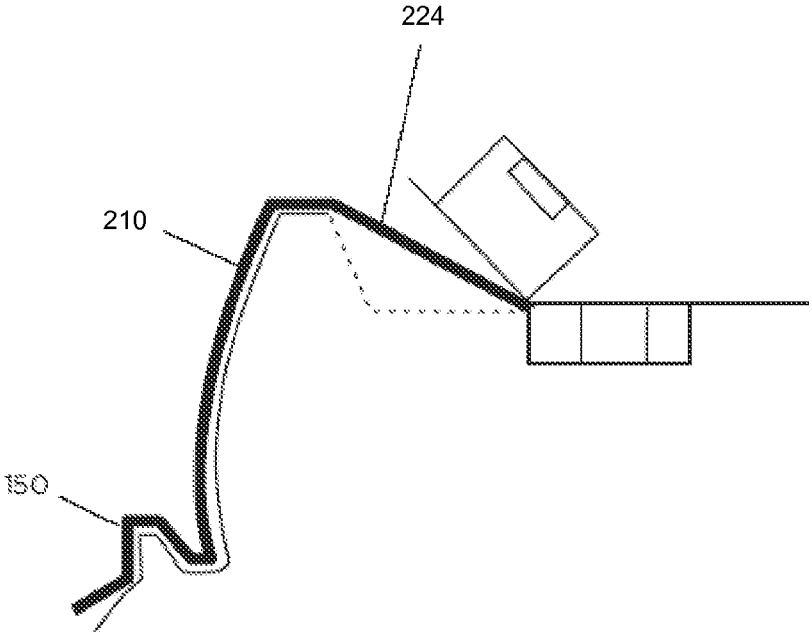
FIG. 8B is a side view of a prior art beverage lid fitted with the sanitary barrier shown in FIG. 8A.

According to another embodiment of the invention, shown in FIGS. 8A and 8B, configured to accommodate prior art beverage lids shown in FIG. 1K, sanitary barrier 210 has a top edge 214. The bottom edge 222 of the sanitary barrier 210 is also curved slightly concave to accommodate the side wall of the lid on which it is attached. This embodiment has two top teeth 223 and 224 that extend forward over the top rim of the prior art lid. The teeth have inside edges (e.g., the right edge of 223 and the left edge of 224) that are generally straight with a space between the edges of approximately 1.5 cm, and from the top of the teeth 223, 224, the outer edges curve down and outward to be even with the dotted line 225 and with the left and right edges of the sanitary barrier 210, which is the pivot point for folding the top teeth over the rim of the beverage container.

There is also an extended pull tab 150, which accommodates the mounting portion of the beverage container lid, as shown in the side plan view in FIG. 8B. Pull tab 150 extends from the sanitary barrier in a rectangular or trapezoidal shape. Pull tab 150 is approximately 1 cm in width to accommodate a user's fingers for easy removal and is approximately 1 to 1.25 cm in length to allow enough room to conform to the contours of the beverage lid and still extend far enough to be easily gripped by a user's fingers.

Figure 9A:
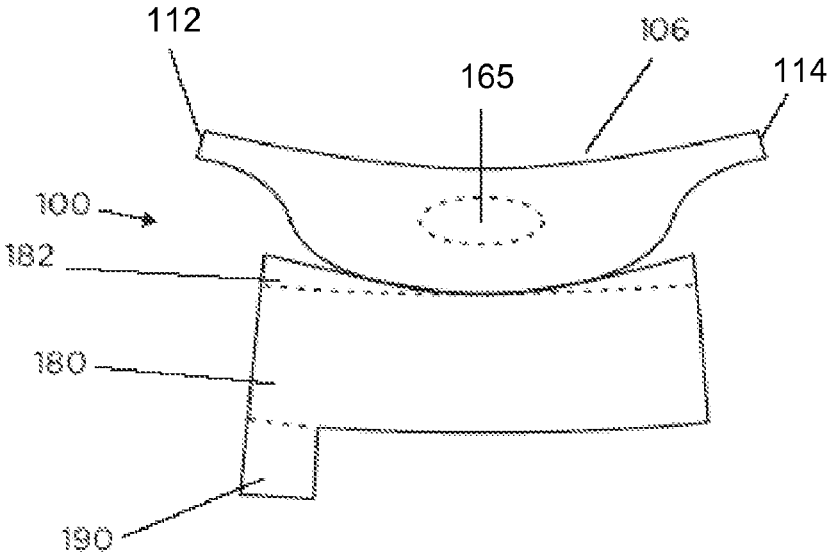
FIG. 9A is a top view of another embodiment of the sanitary barrier, for use with a different prior art lid, shown unattached to a beverage container lid.
Figure 9B:
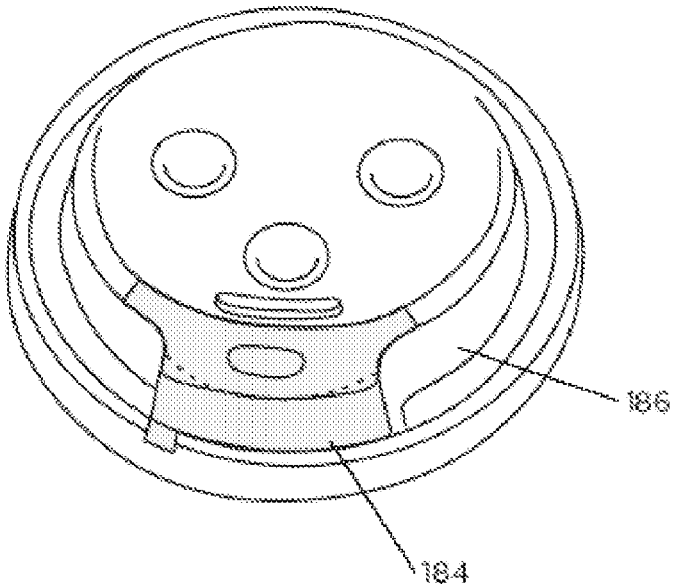
FIG. 9B is a perspective view of a prior art beverage lid fitted with the sanitary barrier shown in FIG. 9A, showing its application in covering the front portion of the lid.

According to another embodiment of the invention, shown in FIG. 9A, sanitary barrier 100 is intended to be applied on prior art beverage lids depicted in FIG. 1H. Left arm 112 and right arm 114 extend outward and slightly upward from the sides of from the center portion 106, which is placed directly over preformed drinking aperture 165. The bottom strip 180 covers the front side wall 184, which creates a drinking platform, unlike other beverage container lids which have an annular side wall. Thus, the drinking platform of this style of beverage container lid does not have a cylindrical shape, as shown in FIG. 9B. There is a pull tab 190, which extends below the front side wall but may be placed in other areas. This embodiment is intended to cover the entire drinking platform of such prior art lid.

Figure 10:
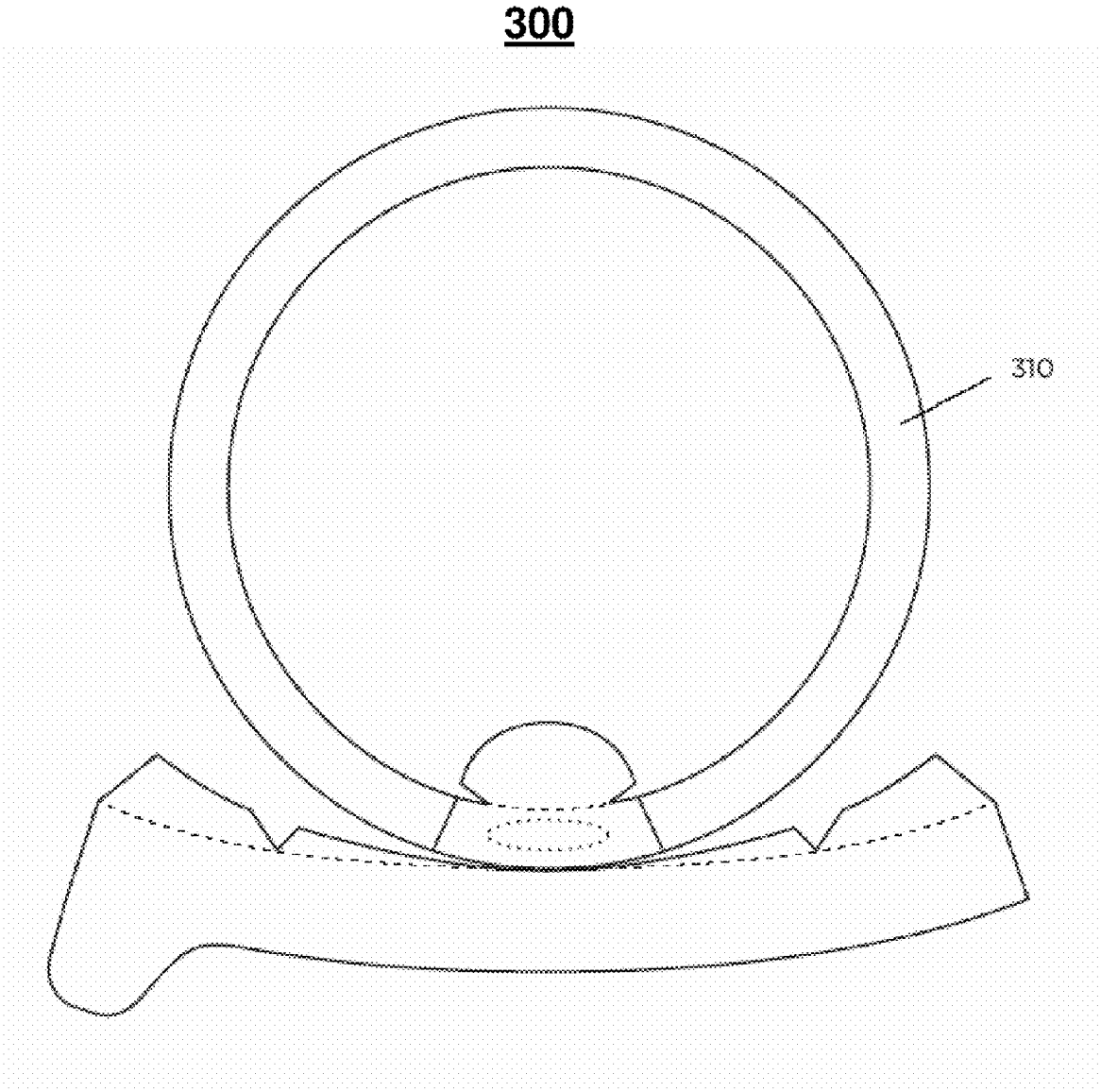
FIG. 10 is a top view of another embodiment of the sanitary barrier, which covers the entire rim of the beverage container lid on which it is applied.

While, in certain embodiments, the sanitary barrier covers at least the area of a beverage container lid that is touched by a drinker's lips and mouth, it may alternatively extend beyond the mouth area and may even extend circumferentially around the entire top rim 40 of a beverage container lid. Thus, according to another embodiment of the invention, shown in FIG. 10, sanitary barrier 300 is similar to any of the sanitary barriers depicted in FIGS. 1-10, except that the upper strip 310, rather than having left and right arms that are provided to extend partway around the rim of the lid, has a circular shape and is intended to cover the entire top rim of a beverage container lid. FIG. 10 depicts an alternative version of the sanitary barrier shown, for example in FIG. 4A, but wherein an upper strip has a uniform width that completely covers the upper rim 40 of the beverage lid. Alternatively, in other embodiments, the width may simply conform to the top rim of the container lid, e.g., the upper strip may taper narrower toward the back of the top rim to accommodate a similar top rim of a beverage container lid.

Figure 11A:
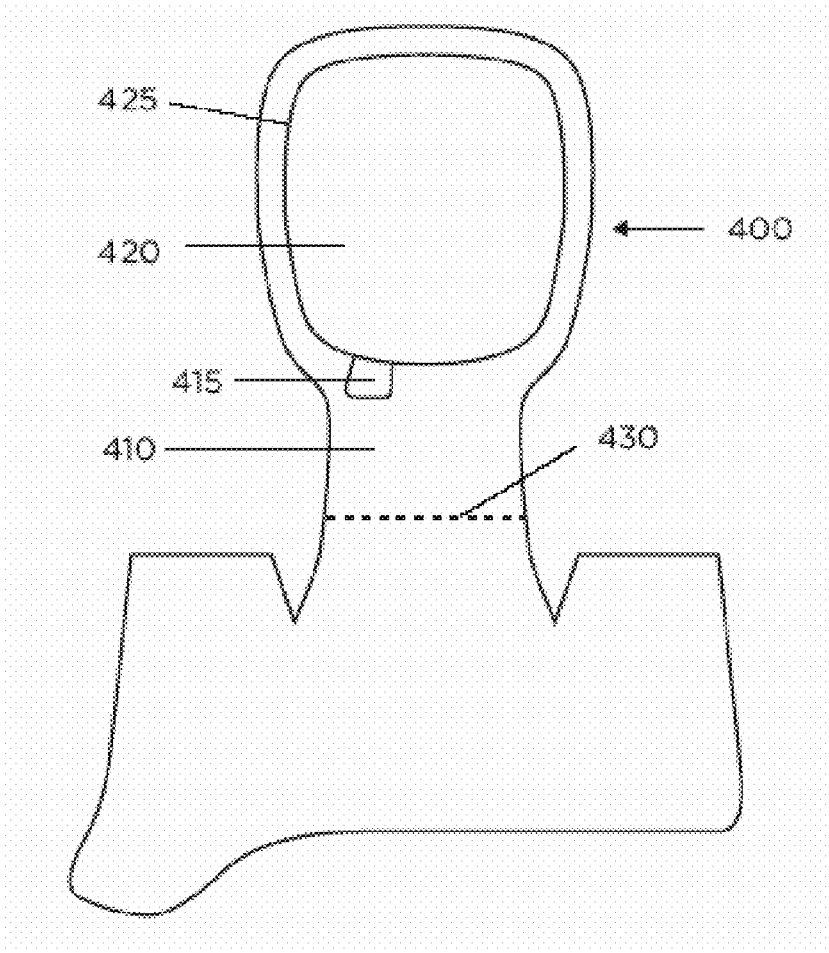
FIG. 11A is a top view of another embodiment of the sanitary barrier, encompassing space for adding a game piece between two layers of material, shown unattached to a beverage container lid.
Figure 11B:
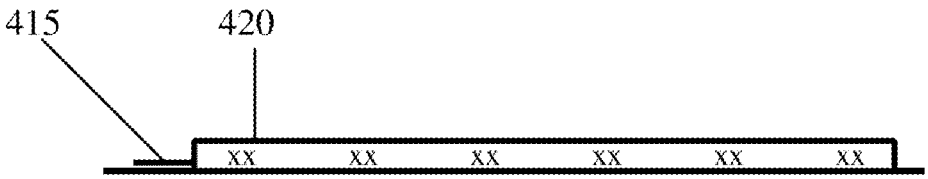
FIG. 11B is a side view of the embodiment of the sanitary barrier shown in FIG. 11A.

In another embodiment, shown in FIG. 11A, extended center portion 400 contains two layers of material, whereby the first layer 410, i.e., the bottom layer, is adhered to the top surface of the beverage lid and the second layer 420, i.e., the top layer, is sealed to the bottom layer around the outer circumference 425 or outer edges of the top layer 420. FIG. 11A shows the top layer 420 being smaller in circumference than bottom layer 410, although the outer edges of the respective layers may be flush against each other or the top layer may be larger in circumference than the bottom layer 410. Top layer 420 may be removed by pull tab 415, which may not be adhered to the first layer and extends from the top layer and may be easily gripped by a user's finger and thumb. In between the two layers is space that may contain a removable game piece or other promotional item. Additionally, this extended center portion may be removable from the remainder of the sanitary barrier by having perforation 430 along the horizontal length of the barrier above the area that covers the preformed drinking aperture of the beverage lid. FIG. 11B shows a side view of extended center portion 400, where pull tab 415 is shown to be parallel to the space XX created between the top layer 420 and bottom layer 410.

Another embodiment of the invention adds an adhesive strip (light adhesive) at the back (away from the user's mouth) part of the top of the lid that has a covering that can be removed and will allow the sanitary barrier to be secured in a "open" position once peeled away from the drinking area—the adhesive keeps the barrier away from the user's mouth but can be unsecured from the back of the top of the lid so as to enable the barrier to be laid over the mouth area (e.g., if the user drinks but then wants to set the lid on a table or other surface it will be covered again for that time).

One skilled in the art will appreciate that the present invention can be practiced by other than the described embodiments, which are presented for purposes of illustration and not limitation. Further, since numerous modifications and changes will readily occur to those skilled in the art, it is not desired to limit the invention to the exact construction and operation shown and described, and accordingly, all suitable modifications and equivalents may be resorted to, without departing from the scope or spirit of the invention as defined in the appended claims.

What is claimed is:

1. A sanitary cover for maintaining the cleanliness of a lid of a beverage container prior to drinking therefrom, said lid having an arcuate planar rim with a drinking aperture formed therethrough, said arcuate planar rim having a cylindrical or frustoconical side wall adjacent an edge of said lid, said sanitary cover comprising:

a thin, flexible, fluid impervious planar sheet of material having an elongate body, said body having an elongate upper portion and an elongate lower portion, a lower side of said body having adhesive applied thereto;

said elongate lower portion to be applied against at least a portion of said side wall of said lid, and said elongate upper portion to be applied against said arcuate planar rim so as to cover said drinking aperture and at least a portion of said arcuate planar rim about said drinking aperture, whereby said elongate lower portion and said elongate upper portion together cover a mouth contact area of said lid;

wherein said elongate upper portion is integrally formed with said elongate lower portion and has at least one slit formed transversely thereacross, said at least one slit forming at least two tabs from said elongate upper portion such that said at least two tabs cover said drinking aperture and at least a portion of said arcuate planar rim about said drinking aperture.

2. The sanitary cover of claim 1 wherein said at least two tabs cover at least a portion of said arcuate planar rim about said drinking aperture with minimal buckling of the material of said sheet.

3. The sanitary cover of claim 1 wherein said at least two tabs partially overlap each other when said elongate upper portion is applied against said arcuate planar rim.

4. The sanitary cover of claim 1 wherein said at least one slit is a V-shaped cutout from said elongate upper portion, and said at least two tabs do not overlap each other when said elongate upper portion is applied against said arcuate planar rim.

5. The sanitary cover of claim 4 wherein edges of said at least two tabs adjacent said V-shaped cutout abut against each other when said elongate upper portion is applied against said arcuate planar rim.

6. The sanitary cover of claim 1 further comprising a pull tab extending from said elongate lower portion.

7. The sanitary cover of claim 1 wherein said adhesive is a food grade adhesive.

8. The sanitary cover of claim 1 wherein said adhesive allows said sanitary cover to be re-adhered to said lid once said sanitary cover has been removed from said lid.

9. The sanitary cover of claim 1 wherein said side wall of said lid is cylindrical, and said elongate lower portion of said sheet of material is substantially straight.

10. A sanitary cover for maintaining the cleanliness of a lid of a beverage container prior to drinking therefrom, said lid having an arcuate planar rim with a drinking aperture formed therethrough, said arcuate planar rim having a frustoconical side wall adjacent an edge of said lid, said sanitary cover comprising:

a thin, flexible, fluid impervious planar sheet of material having an elongate body, said body having an elongate upper portion and an elongate lower portion, a lower side of said body having adhesive applied thereto;

said elongate lower portion to be applied against at least a portion of said side wall of said lid, and said elongate upper portion to be applied against said arcuate planar rim so as to cover said drinking aperture and at least a portion of said arcuate planar rim about said drinking aperture, whereby said elongate lower portion and said elongate upper portion together cover a mouth contact area of said lid;

wherein said elongate lower portion of said sheet of material is arcuate so as to match a contour of said side wall of said lid.

11. A sanitary cover for maintaining the cleanliness of a lid of a beverage container prior to drinking therefrom, said lid having an arcuate planar rim with a drinking aperture formed therethrough, said arcuate planar rim having a cylindrical or frustoconical side wall adjacent an edge of said lid, said sanitary cover comprising:

a thin, flexible, fluid impervious planar sheet of material having an elongate body, said body having an elongate upper portion and an elongate lower portion, a lower side of said body having adhesive applied thereto;

said elongate lower portion to be applied against at least a portion of said side wall of said lid, and said elongate upper portion to be applied against said arcuate planar rim so as to cover said drinking aperture and at least a portion of said arcuate planar rim about said drinking aperture, whereby said elongate lower portion and said elongate upper portion together cover a mouth contact area of said lid;

wherein said elongate upper portion has an arcuate shape with two arms that extend away from said elongate lower portion, said elongate upper portion being integrally connected to said elongate lower portion at a central region between said arms, such that said elongate upper portion arms and central region cover said drinking aperture and at least a portion of said arcuate planar rim about said drinking aperture.

12. The sanitary cover of claim 11 wherein said elongate upper portion arms and central region cover at least a portion of said arcuate planar rim about said drinking aperture with no overlap of said elongate lower portion when said elongate lower portion is applied against said side wall of said lid.

13. The sanitary cover of claim 11 wherein said elongate upper portion arms have lower edges that abut against an upper edge of said elongate lower portion when said elongate upper portion is applied against said arcuate planar rim and said elongate lower portion is applied against said side wall of said lid.

14. The sanitary cover of claim 11 wherein said elongate lower portion comprises at least one tab projecting upward on either side of said integral connection to said elongate upper portion, said upward projections extending over said arcuate planar rim when said elongate lower portion is applied against said side wall of said lid, and said upward projections overlapping or being overlapped by said elongate upper portion arms when said elongate upper portion is applied against said arcuate planar rim.

15. The sanitary cover of claim 11 wherein said lid has a circular planar rim, and said elongate upper portion arms extend completely around said circular planar rim.

16. A sanitary cover for maintaining the cleanliness of a lid of a beverage container prior to drinking therefrom, said lid having an arcuate planar rim with a drinking aperture formed therethrough, said arcuate planar rim having a cylindrical or frustoconical side wall adjacent an edge of said lid, said sanitary cover comprising:

a thin, flexible, fluid impervious planar sheet of material having an elongate body, said body having an elongate upper portion and an elongate lower portion, a lower side of said body having adhesive applied thereto;

said elongate lower portion to be applied against at least a portion of said side wall of said lid, and said elongate upper portion to be applied against said arcuate planar rim so as to cover said drinking aperture and at least a portion of said arcuate planar rim about said drinking aperture, whereby said elongate lower portion and said elongate upper portion together cover a mouth contact area of said lid;

wherein a central region of said elongate upper portion further comprises an upward extension, said central region upward extension extending towards a central region of said lid.

17. The sanitary cover of claim 16 wherein said lid further comprises an inner wall on an opposite side of said arcuate planar rim from said cylindrical or frustoconical side wall, and wherein said central region upward extension is adhered against said inner wall.

18. The sanitary cover of claim 16 wherein said central region of said elongate upper portion further comprises an upper layer and a lower layer and a removable game piece or promotional insert between said upper and lower layers, wherein said removable game piece or promotional insert can be accessed or removed once said upper layer has been removed from said lower layer of said central region of said elongate upper portion.

* * * * *